US011795606B2

(12) United States Patent
Kleindienst et al.

(10) Patent No.: US 11,795,606 B2
(45) Date of Patent: Oct. 24, 2023

(54) PEDESTAL ASSEMBLIES FOR LAUNDRY APPLIANCES

(71) Applicant: WHIRLPOOL CORPORATION, Benton Harbor, MI (US)

(72) Inventors: Skylar R. Kleindienst, Benton Harbor, MI (US); Justin D. Stengel, St. Joseph, MI (US); Jalindar S. Dawange, Nashik (IN); Luiz H. Baptista, São Paulo (BR)

(73) Assignee: Whirlpool Corporation, Benton Harbor, MI (US)

( * ) Notice: Subject to any disclaimer, the term of this patent is extended or adjusted under 35 U.S.C. 154(b) by 39 days.

(21) Appl. No.: 17/538,522

(22) Filed: Nov. 30, 2021

(65) Prior Publication Data

US 2022/0170197 A1 Jun. 2, 2022

Related U.S. Application Data

(60) Provisional application No. 63/119,289, filed on Nov. 30, 2020.

(51) Int. Cl.
*D06F 39/12* (2006.01)
*D06F 39/00* (2020.01)

(52) U.S. Cl.
CPC ..... *D06F 39/125* (2013.01); *D06F 39/001* (2013.01)

(58) Field of Classification Search
None
See application file for complete search history.

(56) References Cited

U.S. PATENT DOCUMENTS

| | | | |
|---|---|---|---|
| 7,685,846 | B2 | 3/2010 | Hwang et al. |
| 7,921,679 | B2 | 4/2011 | Jo |
| 9,742,682 | B2 | 8/2017 | Jain et al. |
| 2005/0172678 | A1 | 8/2005 | Kim et al. |
| 2015/0345063 | A1 | 12/2015 | Sang et al. |

FOREIGN PATENT DOCUMENTS

| | | | |
|---|---|---|---|
| CN | 204690402 | U | 10/2015 |
| CN | 107083655 | A | 8/2017 |
| KR | 20050081345 | A | 8/2005 |
| KR | 20090024009 | A | 3/2009 |
| KR | 20110067886 | A | 6/2011 |
| WO | 2015172571 | A1 | 11/2015 |

OTHER PUBLICATIONS

Author Unknown, LUCKUP 4 Strong Feet Multi-functional Adjustable Base for Dryer, Washing Machine and Refrigerator, Grey, Date Unknown, Amazon.com, 10 pages.

*Primary Examiner* — Rita P Adhlakha
(74) *Attorney, Agent, or Firm* — Brooks Kushman, P.C.

(57) ABSTRACT

A bracket assembly for aligning and securing an appliance with a pedestal may include a pair of appliance brackets are arranged at opposite sides on the underside of the appliance and extend from one edge of the appliance to another. The appliance bracket defines at least one opening configured to receive a shaft of the foot of the appliance and includes a lip extending downward and away from the appliance at the ends of the brackets to engage with a drip tray arranged on the pedestal.

7 Claims, 57 Drawing Sheets

PEDESTAL ASSEMBLIES FOR LAUNDRY APPLIANCES

CROSS-REFERENCE TO RELATED APPLICATION

This application claims the benefit of U.S. provisional application Ser. No. 63/119,289 filed Nov. 30, 2020, the disclosure of which are hereby incorporated in its entirety by reference herein.

TECHNICAL FIELD

Aspects of the disclosure generally relate to pedestal assemblies for laundry appliances.

BACKGROUND

Pedestals are popular add on items for laundry appliances such as washers and dryers. Pedestals may provide for storage, support, leveling, etc. Users may prefer the additional height that pedestals add to the laundry appliance.

SUMMARY

A bracket assembly for aligning and securing an appliance with a pedestal may include a pair of appliance brackets are arranged at opposite sides on the underside of the appliance and extend from one edge of the appliance to another. The appliance bracket defines at least one opening configured to receive a shaft of the foot of the appliance and includes a lip extending downward and away from the appliance at the ends of the brackets to engage with a drip tray arranged on the pedestal.

An adjustable pedestal connector may include at least one sliding bracket configured to be arranged within a drip plan on top of a pedestal and including two portions, one configured to nest and slide within the other to create a custom width to fit within the drip tray, wherein at least one of the two portions define a notch on a distal end thereof to abut a shaft of an appliance foot in an installed and expanded position.

An adjustable pedestal connector may include an appliance bracket including four corner brackets each having a pair of legs forming a right angle at the corner thereof, each leg defining an opening configured to overlap with the opening of the adjacent bracket, wherein the openings are elongated allowing for varying overlap between the adjacent legs to allow for a custom length between the two corner brackets; an attachment mechanism configured to connect the two legs to fix the length of the bracket; and a pedestal bracket configured to be arranged on a pedestal beneath the appliance and attach to the appliance bracket to secure the pedestal to the appliance.

An adjustable pedestal connector may include an appliance base, configured to be arranged on an underside of an appliance, having a foot bracket extending from each corner thereof, where each foot bracket is attached to the base via a pin allowing the foot bracket to be movable in each of a radial and lateral position to adjust the placement of the foot; and at least one projection arranged on an underside of the appliance base and configured to be received by at least one retention rod attached to a pedestal to secure the pedestal to the appliance.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Pedestals are popular add on items for many washer and dryer appliances. Pedestals may provide for storage, support, leveling, etc. Users may prefer the additional height that pedestals add to the washer or dryer appliance. However, pedestals may often be difficult to install, often requiring that the laundry appliance be set on its back or side so that the pedestal can be attached to the underside of the appliance. Furthermore, many pedestals are make and model specific. That is, a laundry appliance of a first make may be incompatible with a pedestal for a laundry appliance of a second make. This may be due in part to the placement of the leveling feet on the appliance, dimension, accessibility, etc.

The pedestal assemblies described herein may provide for more universal attachment methods, allowing pedestals to be easily installed on a variety of different appliances made by various manufacturers.

Figure 1:
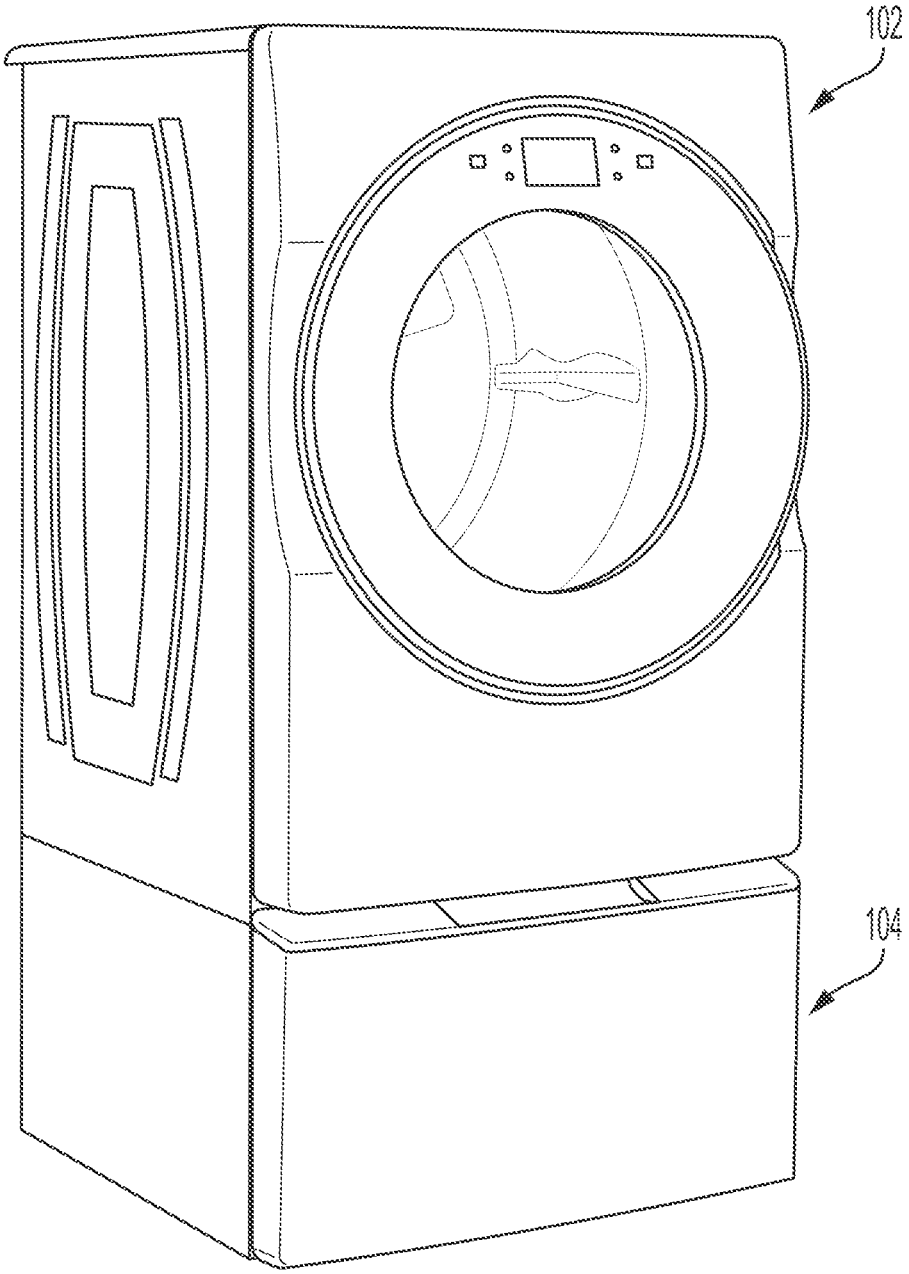
FIG. 1 illustrates a perspective view of an example laundry appliance arranged on top of a pedestal.

FIG. 1 illustrates a perspective view of an example laundry appliance 102 arranged on top of a pedestal 104. The laundry appliance 102 may be a washer for washing laundry, a dryer for drying articles of laundry, or a combination washer and dryer. Other appliances may also be considered. The pedestal 104 may be a cabinet or support configured to maintain the laundry appliance 102 thereon. The pedestal 104 may have a similar width and depth as that of the laundry appliance 102 that it is supporting. The laundry appliance 102 may be secured to the pedestal 104 via various forms discussed herein. Mostly, a set of feet extending from the laundry appliance 102 may be secured to the pedestal.

Figure 2:
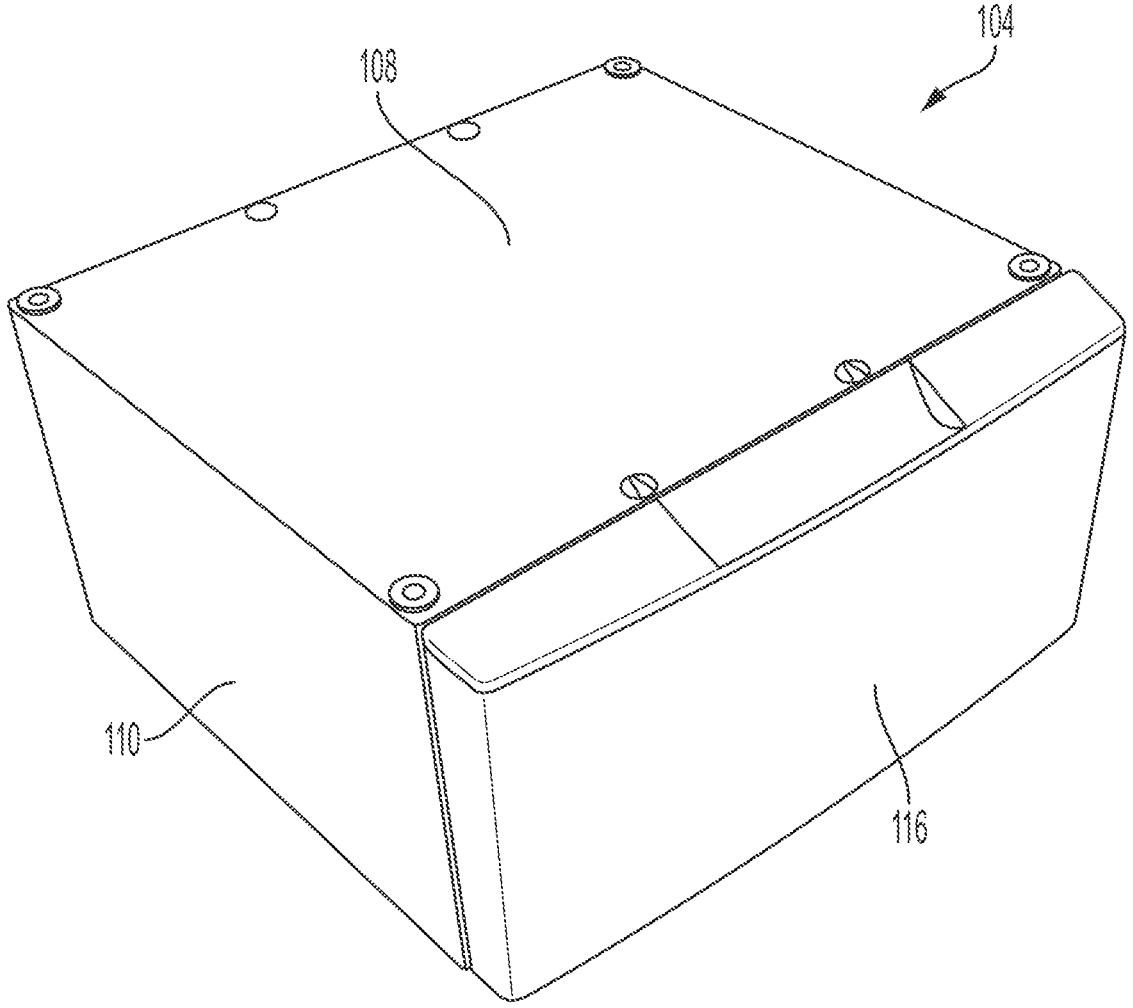
FIG. 2 illustrates a perspective view of the example pedestal of FIG. 1.

FIG. 2 illustrates a perspective view of the example pedestal 104 of FIG. 1. In this example, the pedestal 104 may form a cabinet having a top 108, a bottom (not shown or individually labeled), a first or left side 110, a second or right side 112 (not labeled in FIG. 2), a rear side 114 (not labeled in FIG. 2), and a front side 116. The pedestal 104 may form a hollow center configured to receive a drawer for storage of various items. The front side 116 may include a drawer front with a handle for gaining access to the drawer.

The top 108 of the pedestal 104 may include various connecting locations 118. These connecting locations may include locations where the laundry appliance 102 connects to the pedestal 104. Various examples of these connecting configurations are described herein. Although the figures and description herein relate to appliances arranged on top of a pedestal, the concepts disclosed herein may also relate to stacking appliances on top of each other. For example, in some situations a dryer may be stacked on top of a washing machine.

Figure 3:
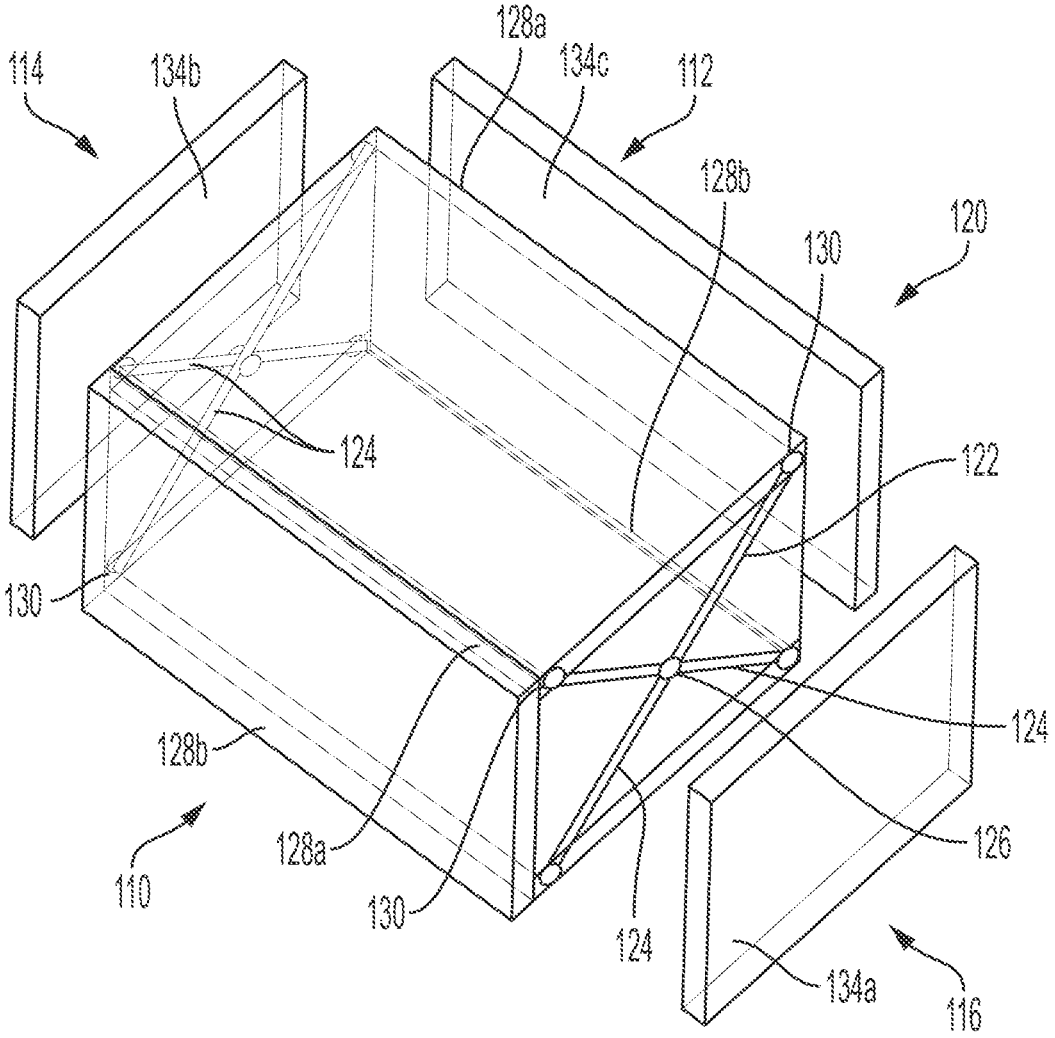
FIG. 3 illustrates a perspective exploded view of an example pedestal assembly.
Figure 4:
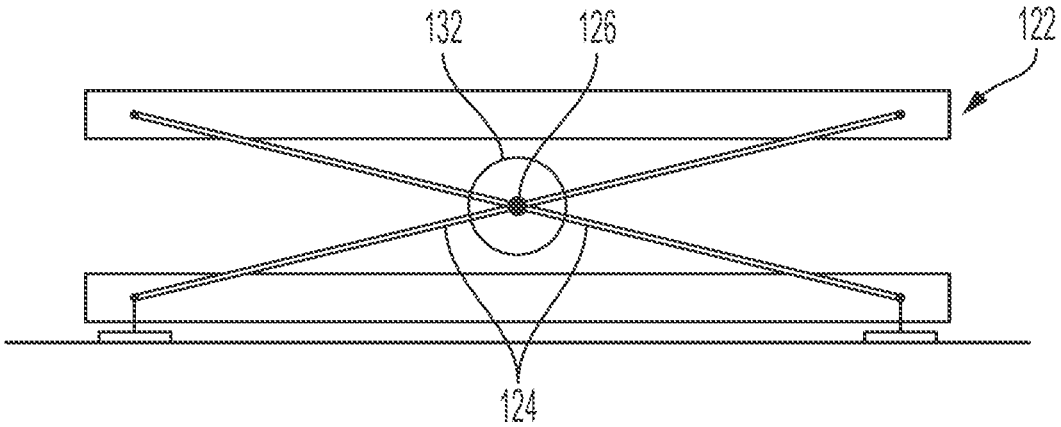
FIG. 4 illustrates a side view of the example pedestal assembly of FIG. 3.

FIG. 3 illustrates a perspective exploded view of an example pedestal assembly 120. FIG. 4 illustrates a side view of the example pedestal assembly 120 of FIG. 3. The pedestal assembly 120 may include a support structure 122 having a plurality of pivotable supports that allow for the height of the pedestal to be adjusted.

A pair of cross-hinged supports 124 may form two opposite sides of the support structure 122. The cross-hinged supports 124 may be connected at a central hinge 126 and be configured to move axially with respect to one another at the central hinge 126. The two sets of cross-hinged supports 124 may be attached to at least one horizontal support 128 at a corner 130. The horizontal supports 128 may attach from one end of a cross-hinged support 124 on one side, to another cross-hinged support 124 on the opposite side. An opposite and parallel horizontal support 128 may be attached at the opposite ends of the cross-hinged supports 124, forming a quadratic shape of the support structure 122.

The horizontal supports 128 may include an upper horizontal support 128*a* and a lower horizontal support 128*b*. The upper horizontal support 128*a* may be arranged above and parallel to the lower horizontal support 128*b*. The horizontal supports 128 may create a box-like structure out of the supports where a pair of horizontal supports 128 are arranged opposite and parallel another pair of horizontal supports 128, with the cross-hinged supports 124 being arranged on each side between the horizontal supports 128. The spacing between the upper horizontal support 128*a* and the lower horizontal support 128*b* may change as the cross-hinged supports 124 pivot at the central hinge 126. That is, as the ends of the cross-hinged supports move closer together, the space between the upper horizontal support 128*a* and the lower horizontal support 128*b* decreases. Conversely, as the ends move further apart, the space between the two supports 128*a*, 128*b* increases.

The support structure 122 may be movable between a collapsed state where the upper and lower horizontal supports 128*a*, 128*b* are touching or nearly touching, and an extended state where the upper and lower horizontal supports 128*a*, 128*b* are at a predefined optimal distance apart. This optimal distance may correlate with an optimal height for the assembled pedestal assembly 120. Because the supports of the support structure move relative to one another, as the height of the support structure increases, the width and depth necessarily decrease. Thus, upon achieving an optimal height, and optimal width may also be achieved. It may be noted that while both upper and lower horizontal supports 128 are illustrated in the figures, more or fewer horizontal supports may be included. For example, one of the upper or lower horizontal supports 128*a*, 128*b* may be omitted.

Once the support structure 122 reaches the optimal height and/or width, at least one side panel 134 may be installed onto the support structure 122. The side panels 134 may correspond to the optimal height and width in that each side panel may fit onto the support structure 122 to cover a respective side of the support structure 122. The side panels 134 may include at least one of a front side panel 134*a*, a rear side panel 134*b*, a right side panel 134*c*, and a left side panel (not shown). The side panels 134 may be installed once the support structure 122 is in the extended position. The side panels 134 may be magnetic and may be configured to magnetically attach to the support structure 122. Although not shown, a top panel may be placed on top of the support structure 122 to support the laundry appliance 102 thereon.

The cross-hinged supports may be movable via a gear 132 (shown in FIG. 4) arranged on at least one of the central hinges 126. The gear 132 may be a worm gear having a worm wheel actuatable by a worm drive or screw that drives the cross-hinged supports 124 in one direction or the other. A user may adjust the height of the support structure 122 by turning the worm drive. The drive may be a manual drive and/or be configured to be used with a drill as an attachment.

The support structure 122 may be shipped in the collapsed state. The low profile of the support structure, and the uninstalled side panels 134 may allow for a sleek, easily storable and shippable package. Once delivered, an installer may expand the support structure 122 via the gear 132. Once the support structure has reached the optimal height, the top panel and the side panels 134 may be installed. In some examples only the front side panel 134*a* may be installed if the other sides are not visible.

Further, prior to expansion, the top panel may be placed on top of the support structure 122. The laundry appliance 102 may then be tipped back while the support structure 122 is slid under the laundry appliance 102. Once the laundry appliance 102 is resting on the top panel, the support structure 122 may then be expanded. This allows the laundry appliance 102 to be placed on the pedestal assembly 120 while the pedestal assembly 120 is in a lower, collapsed state and prevents the need for the installer to lift the laundry appliance 102 onto what could be a much higher surface, or tip the laundry appliance 102 completely on its side to attach the pedestal assembly 120.

The gear 132 may be arranged at the front side 116 of the support structure 122 so as to be easily reachable during installation. Moreover, after installation, it may be possible to remove the side panels 134 and lower the support structure 122 via the gear 132 to lower the laundry appliance 102. This may make accessibility to the laundry appliance 102 easier in the event of needed repairs, unit replacements, cleanings, etc.

The laundry appliance 102 may be attached to the pedestal assembly 120 via tethers or any of the mechanisms disclosed herein. While the example shown herein shows the side panels 134 as being flat, other decorative configurations may also be included. Further, a drawer may be installable within the pedestal.

Figure 5:
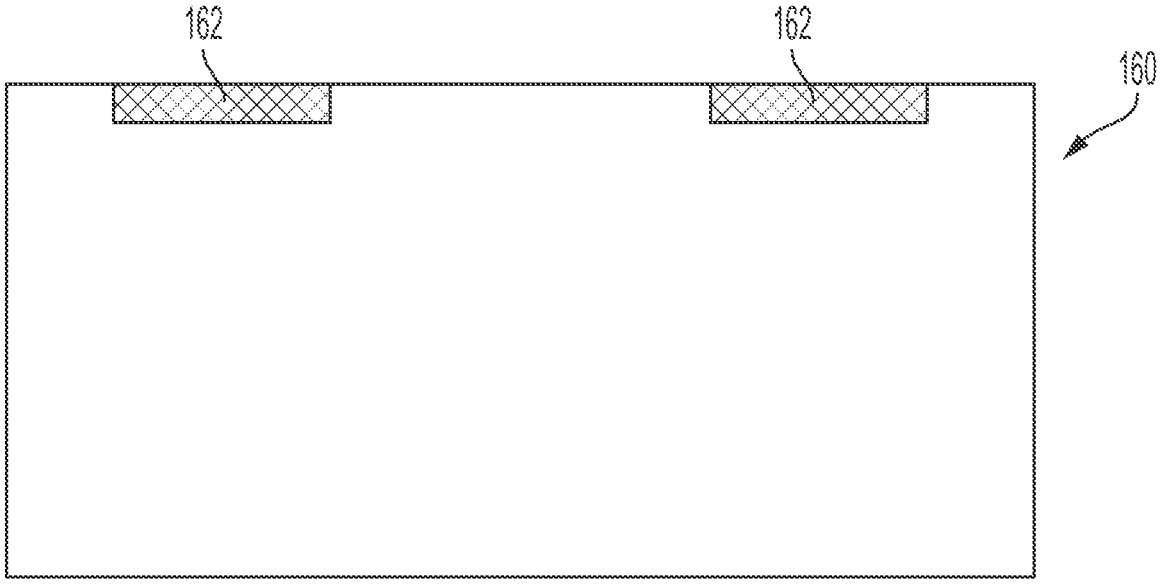
FIG. 5 illustrates a front elevational view of an example pedestal assembly having a plurality of plates arranged on the top 108 of the pedestal assembly.

FIG. 5 illustrates a front elevational view of an example pedestal assembly 160 having a plurality of plates 162 arranged on the top 108 of the pedestal assembly 160. The plates 162 may be metallic or magnetic and configured to mate with other magnetic materials. In one example, the plates 162 may be arranged at the connecting locations as illustrated in FIG. 2. The plates 162 may be arranged within the pedestal assembly 160, just underneath the top 108, so as to not be visible at the exterior of the pedestal assembly 160.

Figure 6:
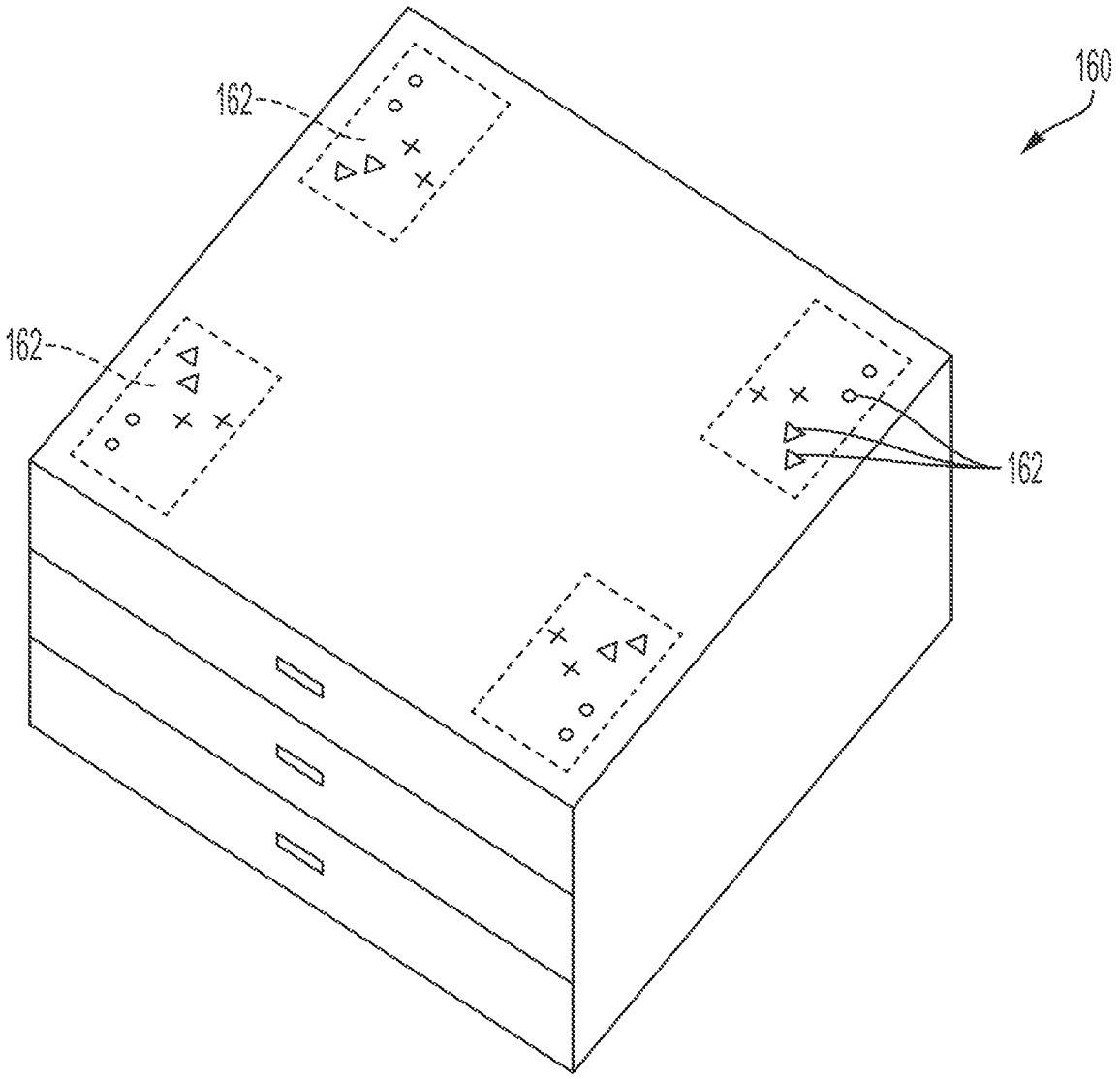
FIG. 6 illustrates a perspective view of the example pedestal assembly of FIG. 5.

FIG. 6 illustrates a perspective view of the example pedestal assembly 160 of FIG. 5. The top 108 of the pedestal assembly 160 and the plates 162 arranged underneath may define at least one mating opening 164. The mating opening 164 may include a plurality of mating openings 164 configured to receive pins from feet attached to the laundry appliance 102.

Figure 7:
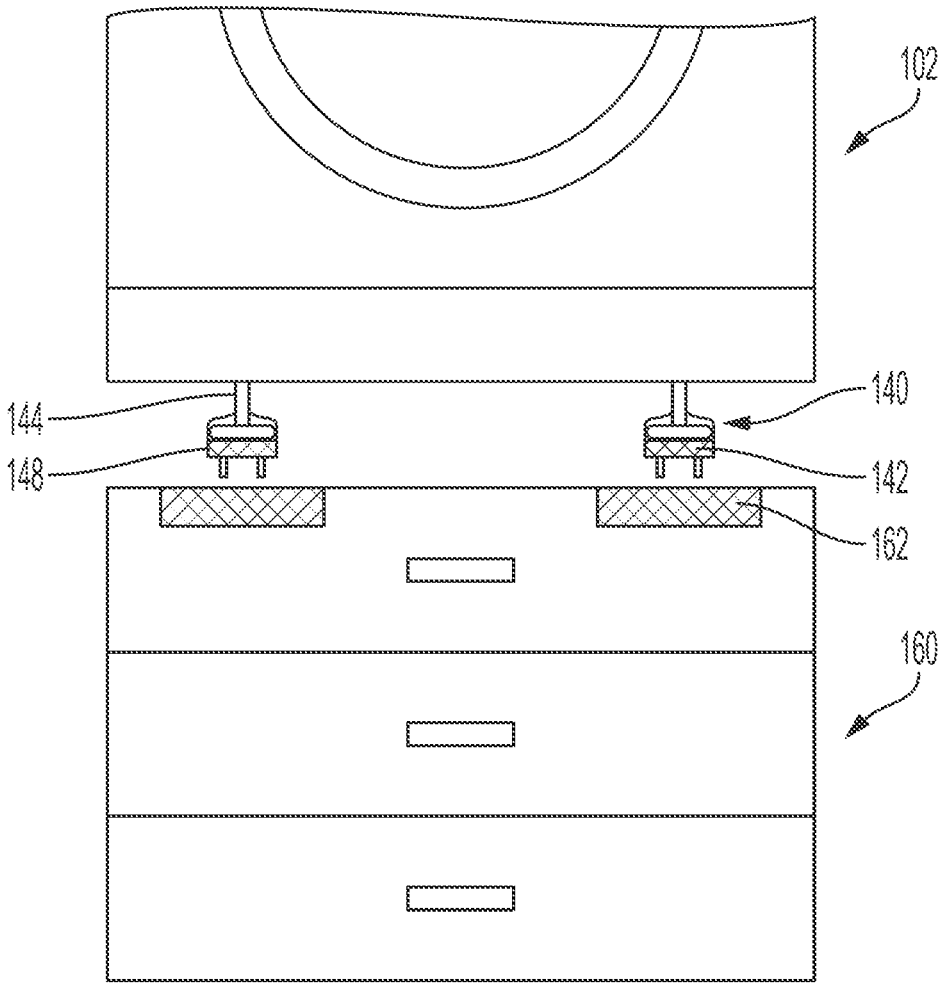
FIG. 7 illustrates a front view of the example pedestal of FIGS. 5 and 6 and a laundry appliance having a plurality of feet extending therefrom.

FIG. 7 illustrates a front view of the example pedestal assembly 160 of FIGS. 5 and 6 and a laundry appliance 102 having a plurality of feet 140 extending therefrom. Each foot 140 may include a base 142, or resilient surface, extending perpendicular to a shaft 144. The shaft 144 may be threaded and configured to screw into the bottom of the laundry appliance 102. The threaded shaft 144 may allow for the laundry appliance 102 to be leveled with respect to the pedestal assembly 160. At least one pin 148 may extend from the base 142 on an opposite side of the shaft 144. The at least one pin 148 may be configured to be received by the mating openings 164 of the pedestal assembly 160 in order to aid in aligning the laundry appliance 102 with the pedestal assembly 160.

In the example shown in FIG. 7, the pin 148 may include a plurality of pins 148. The pins 148 may form a certain pattern or arrangement that is specific to a make or model of the laundry appliance 102. The pins 148 may also have different widths, shapes, depths, etc., specific to a certain laundry appliance 102. The foot 140 of one make and model may include x number of pins spaced apart in a certain spatial configuration, while another foot 140 for another make and/or model may include y number of pins spaced apart in a different spatial configuration. The mating openings 164 may be defined by the plate 162 and configured to receive the pins 148 of each of the different pin configurations to aid in aligning the laundry appliance 102 with the pedestal assembly 160.

Returning to FIG. 6, the mating openings 164 may not only have various pin configurations but may also be formed of varying shapes. Thus, a series of mating openings 164 may receive one configuration of pins, and another series of holes may receive another configuration of pins. This allows for a single pedestal 104 to be configurable to fit underneath a plurality of different appliance makes and models. For example, one set of openings may be configured to receive the foot of a laundry appliance of a first make, another set of openings may be configured to receive the foot of a laundry appliance of a second make, and yet a third set of openings may be configured to receive the foot of a laundry appliance of a third make.

Figure 8:
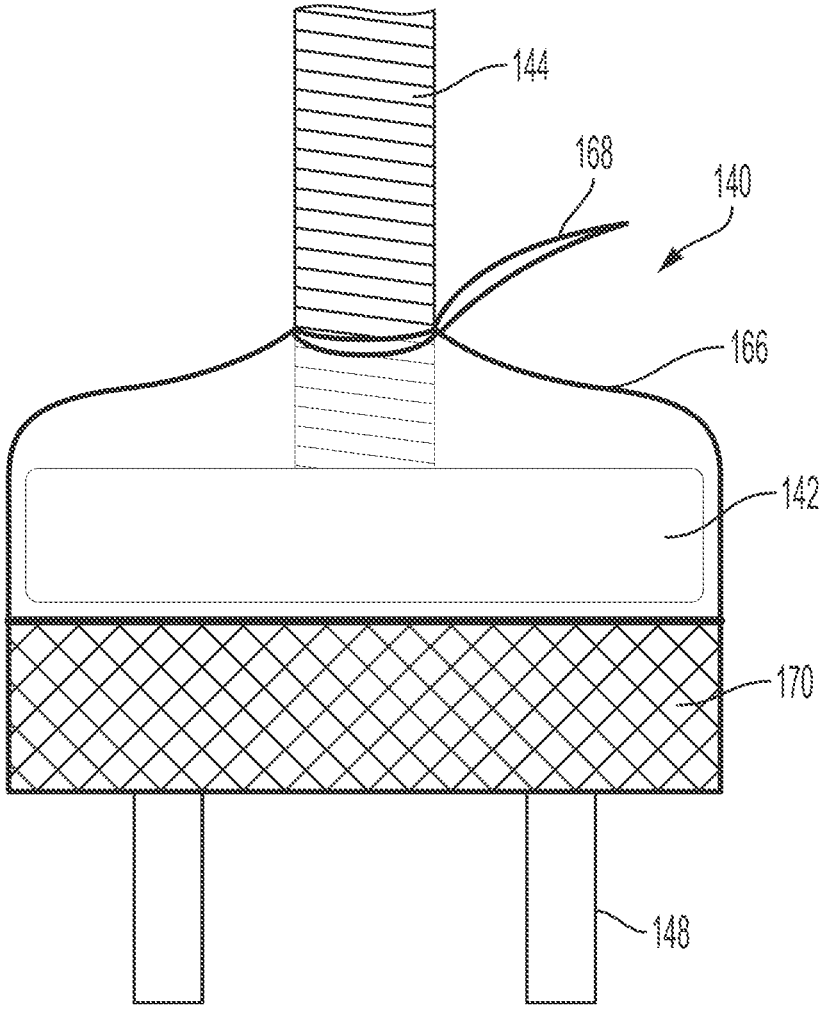
FIG. 8 illustrates a side view of another example appliance foot.

FIG. 8 illustrates a side view of another example appliance foot 140. A flexible cover 166 may be configured to wrap around the foot 140 of the laundry appliance 102. The flexible cover 166 may be made or include a magnetic material configured to couple with the plate 162. The flexible cover 166 may be held in place via a clamp 168 or zip tie arranged and tightened about the shaft 144. The flexible cover 166 may define openings allowing the pins 148 to extend therefrom. In another example, the pins 148 may be integral to the cover and extend therefrom. The combination of the pins 148 received at the mating openings 164 and the magnetic mating between the plate 162 and the flexible cover 166, the laundry appliance 102 may be securely fixed to the pedestal assembly 160.

A rubber pad 170 may also be arranged between the pins 148 and the base 142 to provide cushion dampening between the base 142 and the top 108 of the pedestal assembly 160. The rubber pad 170 may aid in mitigating vibrations during operation of the laundry appliance 102, as well as in stabilizing and leveling the laundry appliance 102 and in prevention of scratching of the pedestal assembly 160 by the foot 140.

Figure 9:
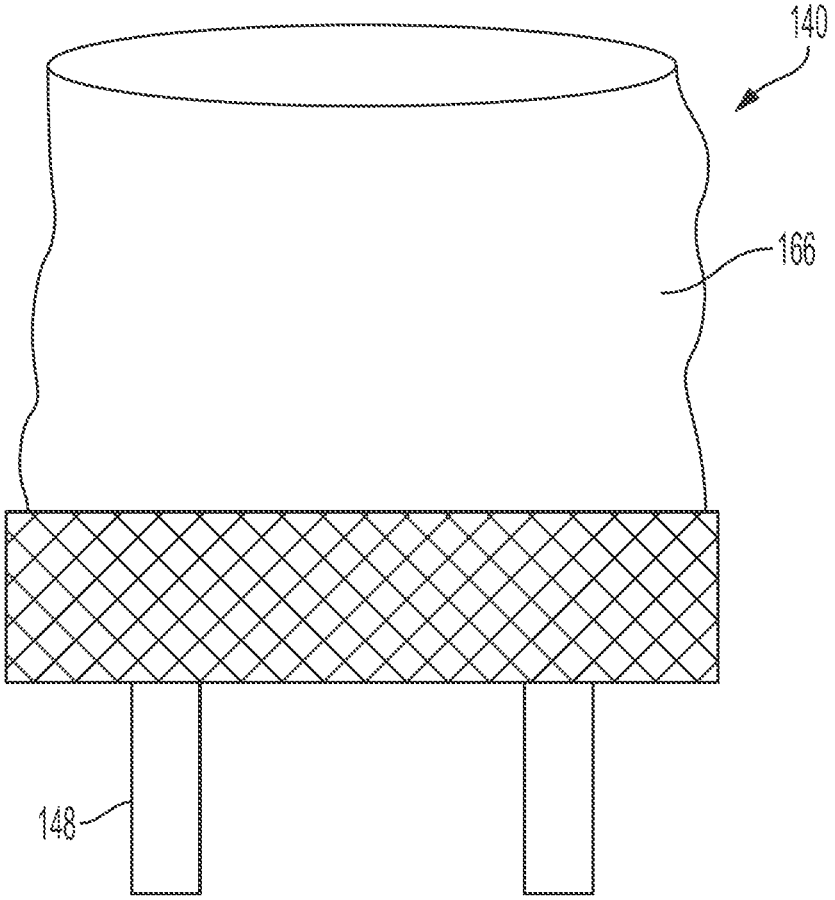
FIG. 9 illustrates a side view of another example appliance foot including the flexible cover 166 in an unclamped state.

FIG. 9 illustrates a side view of another example appliance foot 140 including the flexible cover 166 in an unclamped state.

Figure 10:
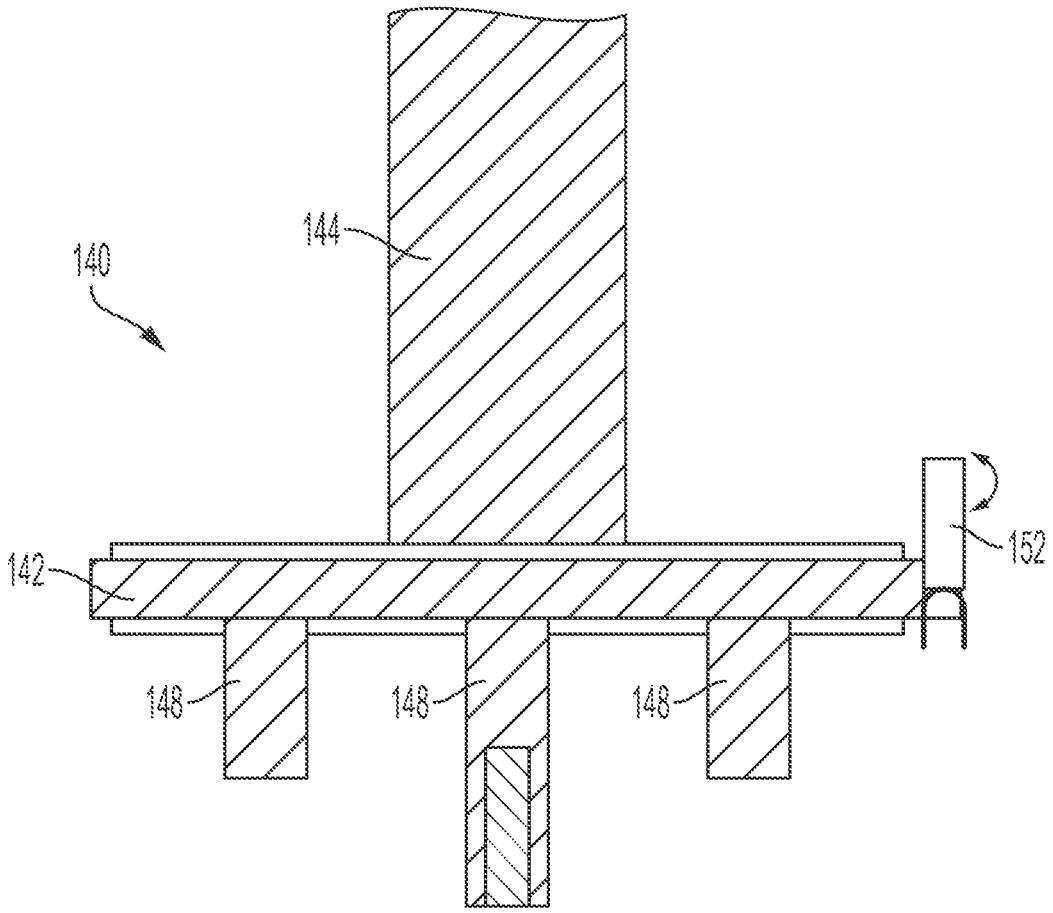
FIG. 10 illustrates a side view of another example appliance foot for attaching to the pedestal assembly.
Figure 11:
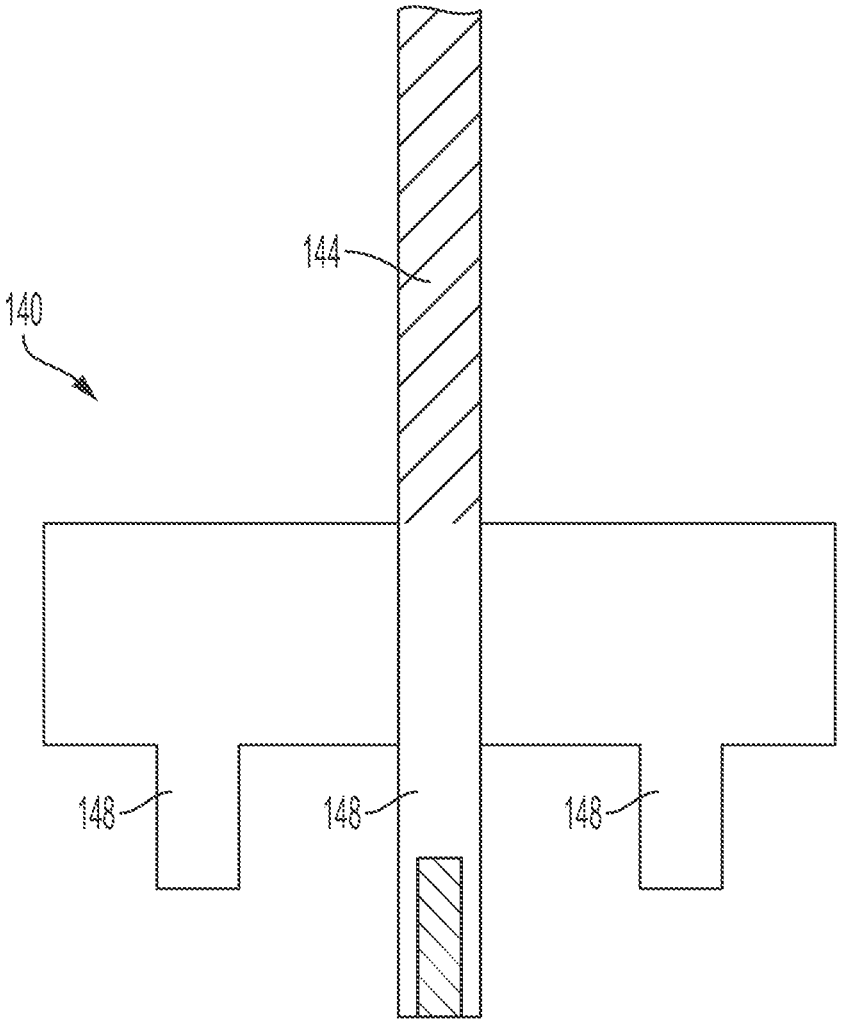
FIG. 11 illustrates a side view of another example appliance foot for attaching to the pedestal assembly.

FIGS. 10 and 11 illustrate a side view of another example appliance foot 140 for attaching to the pedestal assembly 160. As explained above, the pedestal assembly 160 may include a plurality of pins 148 that form a pattern or arrangement that is specific to a make or model of the laundry appliance 102. The pins 148 may also have different widths, shapes, depths, etc., specific to a certain laundry appliance 102.

The base 142 may include a magnetic component 150 configured to magnetically couple with a magnetic component at the plate 162. The magnetic component 150, similar in operation to the flexible cover 166 of FIGS. 8 and 9, may aid in securing the foot 140 to the pedestal 104 and preventing horizontal and vertical movement of the foot 140 relative to the pedestal 104.

A latch 152 may be arranged on the pedestal 104 and configured to pivot to clasp over at least a portion of the base 142 of the foot 140 to further secure the foot 140 to the pedestal 104. The latch 152 may be a pivot pin extending from the pedestal 104 and be moveable between an open position and a locked position, wherein the locked position limits movement of the foot 140 with respect to the pedestal 104.

Figure 12:
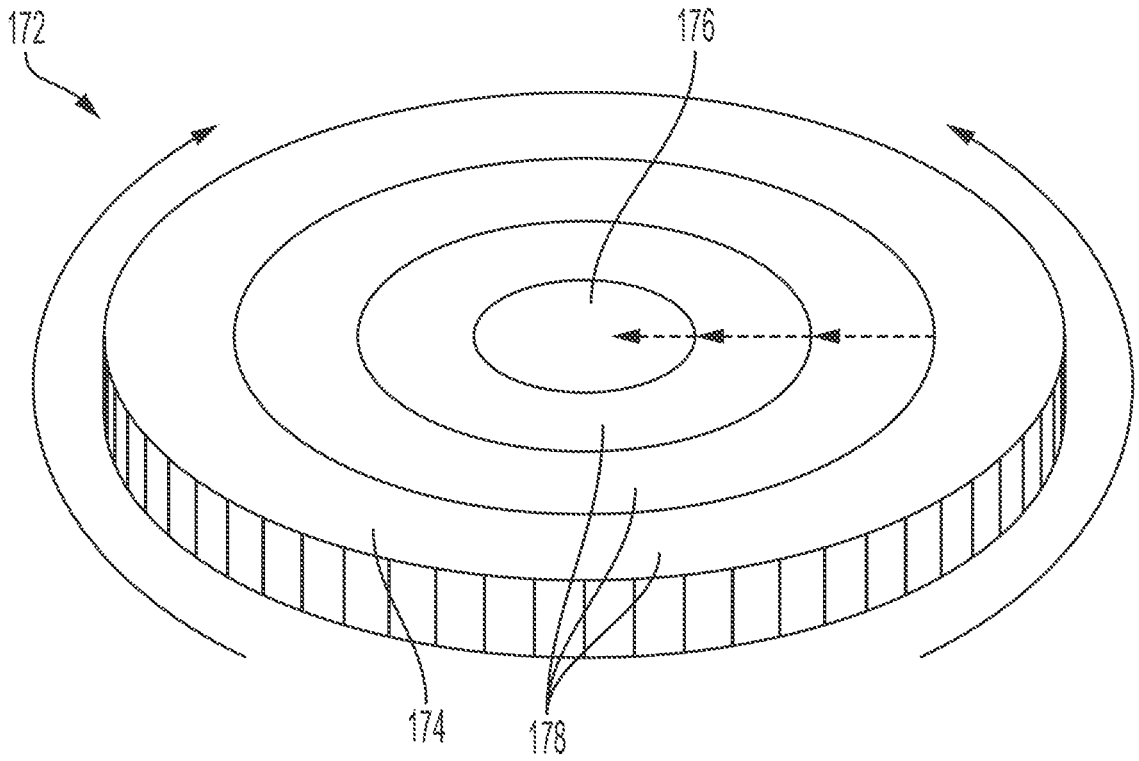
FIG. 12 illustrates a perspective view of an example connector configured to be arranged on the pedestal and configured to accept a foot of the laundry appliance.
Figure 13A:
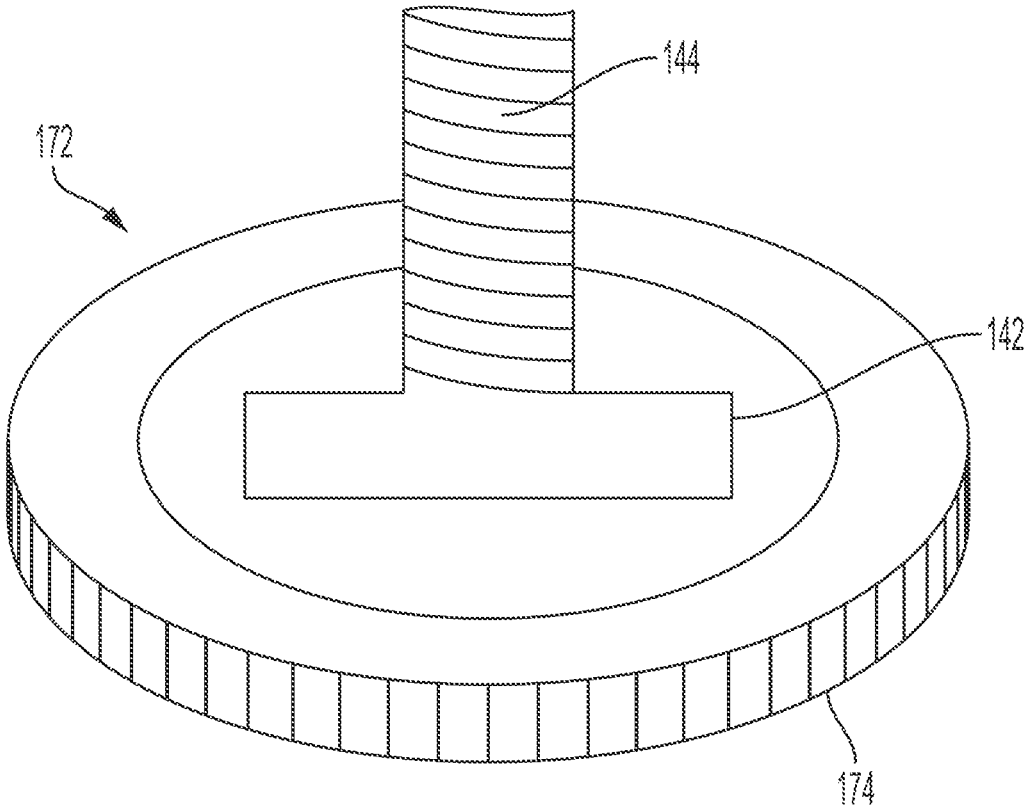
FIG. 13A illustrates a perspective view of the example connector of FIG. 12 in an open state.
Figure 13B:
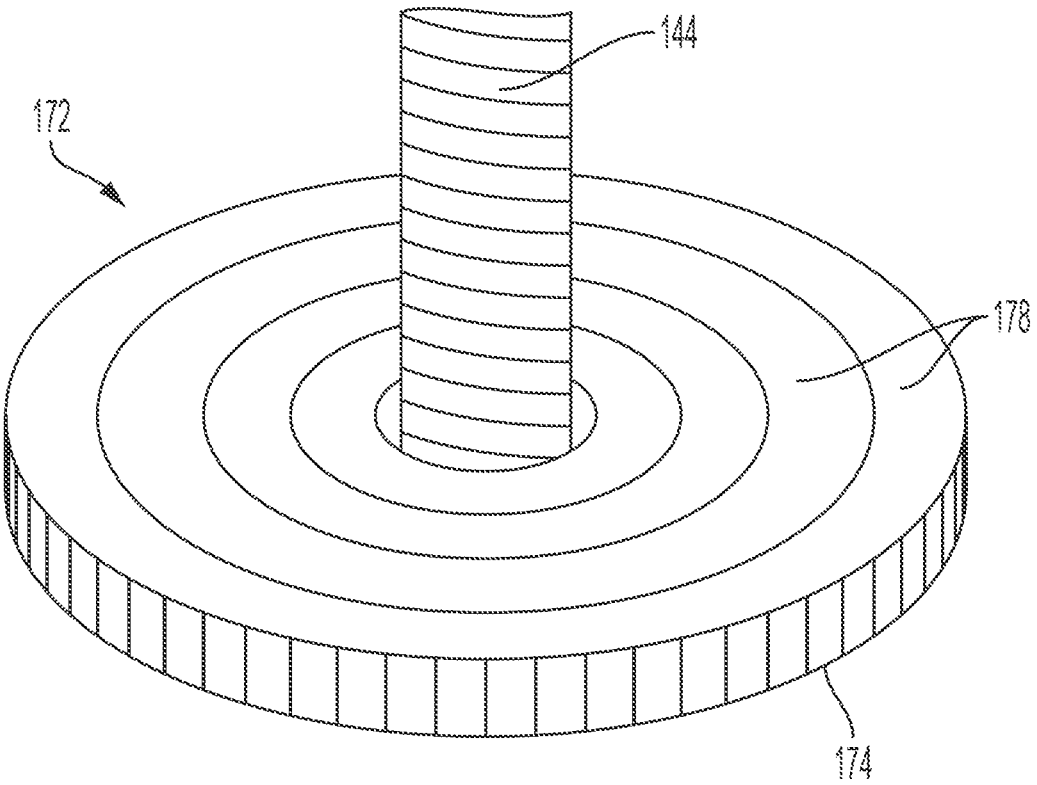
FIG. 13B illustrates a perspective view of the example connector of FIG. 12 in a closed state.

FIG. 12 illustrates a perspective view of an example connector 172 configured to be arranged on the pedestal 104 and configured to accept a foot 140 of the laundry appliance 102. FIG. 13A illustrates a perspective view of the example connector 172 of FIG. 12 in an open state. FIG. 13B illustrates a perspective view of the example connector 172 of FIG. 12 in a closed state. The connector 172 may be a circular cover 174 defining an opening 176 in the center thereof. A top of the connector 172 may include a plurality of grippers 178 extending radially inwardly from an outer perimeter of the cover 174. The grippers 178 may, upon rotation of the circular cover 174, expand inwardly towards the center of the cover 174. The grippers 178 may also be configured to retract towards the outer perimeter of the cover 174 in response to rotation in the opposite direction.

The sides of the cover may include a grip-bar type surface to allow a user to easily grip and rotate the cover 174. The grippers 178 may determine the size of the opening 176 and the opening 176 may be configured to vary in size. The grippers are made of at least one of metal and silicon. The cover 174 may also be made of metal or silicon.

Referring to FIG. 13A, the opening 176 may, in an open state, be configured to accept a base of a foot (e.g., the base 142 of the examples shown in FIGS. 8-11). In this state, the grippers 178 may be retracted towards the outer permitted of the cover 174 in order to allow the opening to be wide enough to accept the base of the foot during installation.

Referring to FIG. 13B, the opening 176 may then, in a closed state, close over the base of the foot and abut, or nearly abut, the shaft 144. In this closed state, the cover 174 may secure the foot 140 therein and prevent horizontal or vertical movement of the foot 140 with respect to the pedestal. This connector 172 allows for various sizes of feet, e.g., of various makes and models of laundry appliance 102, to be secured to the pedestal 104 without appliance-specific dimensions, tools, etc. Thus, the cover 174 provides for a generally universal attachment mechanism for the laundry appliance 102 and the pedestal 104.

Figure 14A:
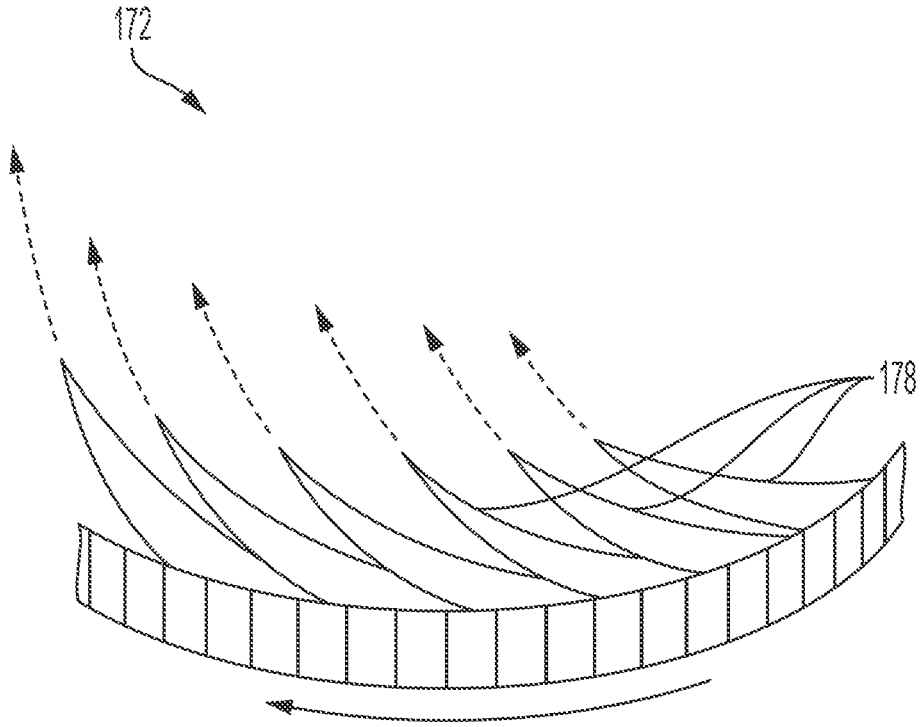
FIG. 14A illustrates a partial perspective view of the example grippers of the connector of FIG. 12 when the cover is rotated in a first direction.

FIG. 14A illustrates a partial perspective view of the grippers 178 of the connector 172 of FIG. 12 when the cover 174 is rotated in a first direction. In this example, the cover 174 may be rotated in a clockwise direction to tighten the grippers 178 over the foot 140.

Figure 14B:
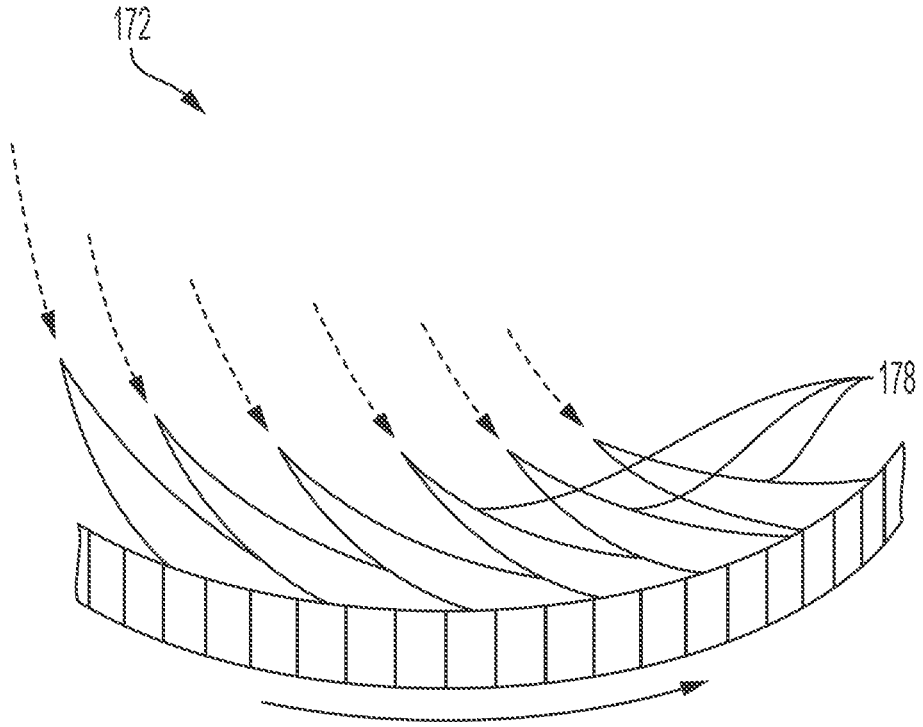
FIG. 14B illustrates a partial perspective view of the example grippers of the connector of FIG. 12 when the cover is rotate in a second direction.

FIG. 14B illustrates a partial perspective view of the grippers 178 of the connector 172 of FIG. 12 when the cover 174 is rotated in a second direction opposite the first direction. In this example, the cover 174 may be rotated in a counter-clockwise direction so as to loosen the grippers 178.

Figure 15:
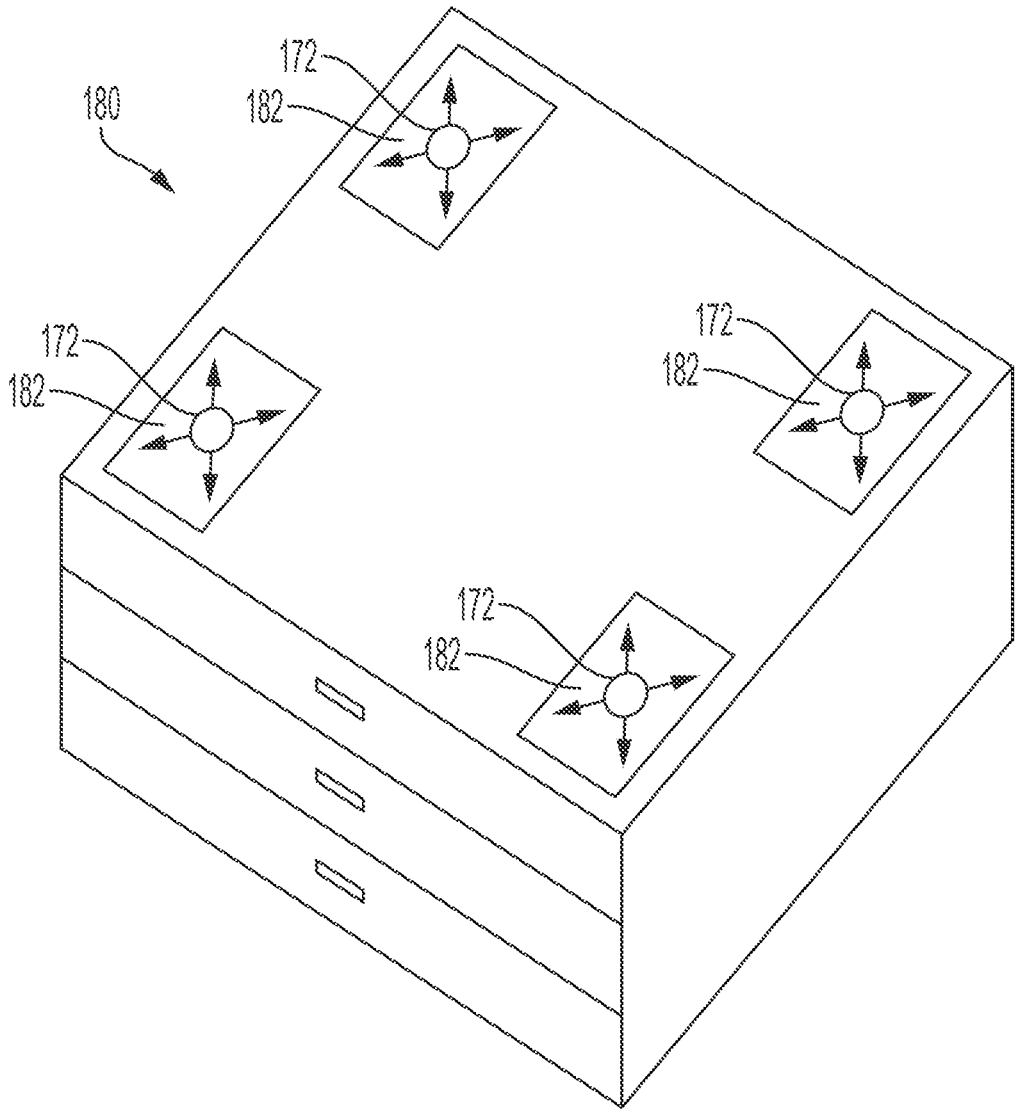
FIG. 15 illustrates a perspective view of another example pedestal assembly having a plurality of pads arranged at or around the connecting locations.

FIG. 15 illustrates a perspective view of another example pedestal assembly 180 having a plurality of pads 182 arranged at or around the connecting locations 118 (as shown in FIG. 2). The connector 172 may be configured to be placed on the pads 182 at various locations. The location at which the connector 172 may be placed may depend on the specific make and model of the laundry appliance 102. That is, the connectors 172 may be arranged on the pads 182 to align with the feet 140 extending from the laundry appliance 102 above.

In one example, the pad 182 may be magnetic, similar to the plates 162 described above. The connector 172 may also be magnetic and may be connected to the pad via the magnetic attachment. This allows for varying locations of the connector 172 on the pedestal assembly 180 at the installation stage instead of the manufacturing state, allowing for greater flexibility and versatility for the pedestal assembly 180.

Figure 16:
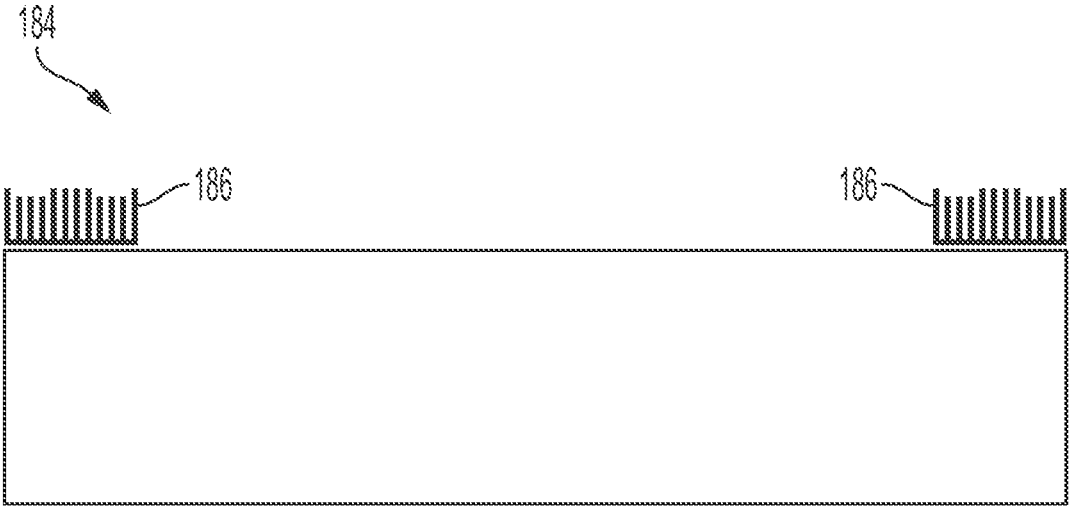
FIG. 16 illustrates a front elevational view of a pedestal assembly having a plurality of pin assemblies arranged on the top of the pedestal assembly.

FIG. 16 illustrates a front elevational view of a pedestal assembly 184 having a plurality of pin assemblies 186 arranged on the top 108 of the pedestal assembly 184. Similar to FIGS. 2 and 5, the pin assemblies 186 may be arranged at locations on the top 108 of the pedestal assembly 184 where the foot of an appliance is likely to rest.

Figure 17:
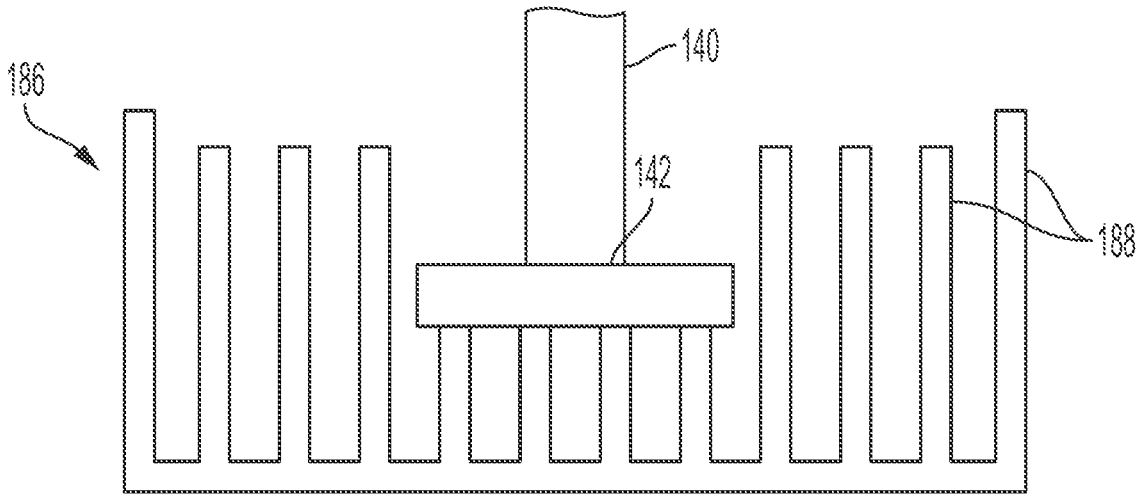
FIG. 17 illustrates a front view of one of the pin assemblies with a foot arranged thereon.

FIG. 17 illustrates a front view of one of the pin assemblies 186 with a foot 140 arranged thereon. The pin assembly 186 may include a plurality of spring-loaded pins 188 extending upward from the pedestal assembly 184. In an installed state, portion of the spring-loaded pins 188 may be depressed underneath the foot 140. The remaining spring-loaded pins 188 may maintain a vertically rigid orientation to abut the base 142 of the foot 140 and prevent lateral or horizontal movement thereof. Although not shown, a latch, similar to the latches and clamps described herein, may extend from the pedestal assembly 184 and clamp over the base 142 of the foot 140 to further secure the foot 140 to the pedestal assembly 184 and prevent vertical movement of the foot 140.

Because the pin assembly 186 may receive various sizes and shapes of appliance feet, the pin assembly 186 allows for a versatile attachment mechanism for the pedestal assembly 184 so that the pedestal assembly 184 may be secured to various makes and models of laundry appliance 102.

Figure 18:
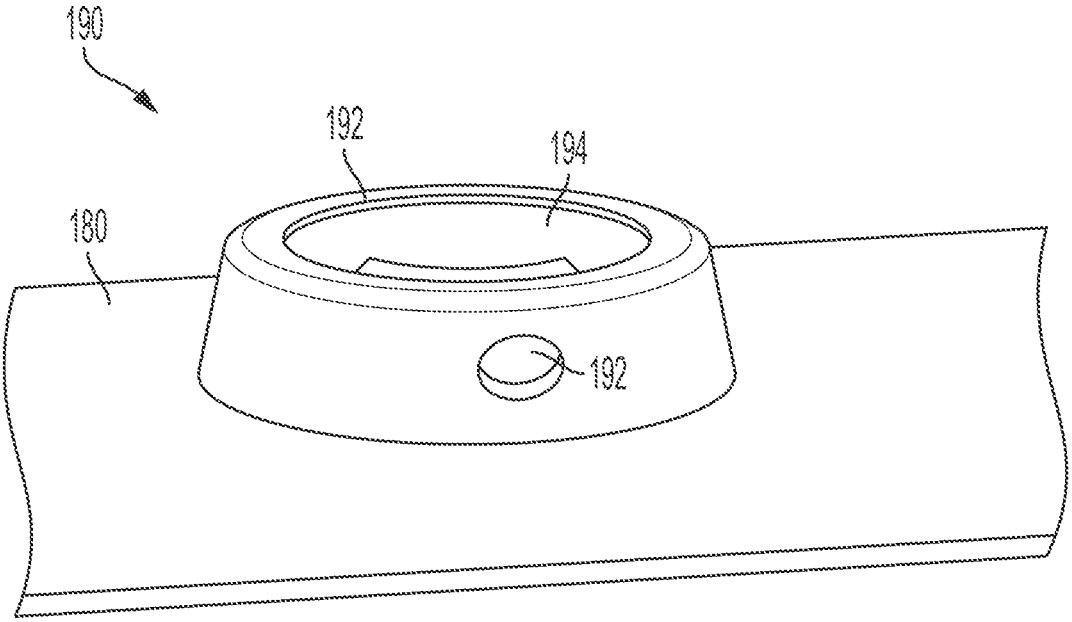
FIG. 18 illustrates a perspective view of another example connector configured to accept a foot of the laundry appliance.
Figure 19:
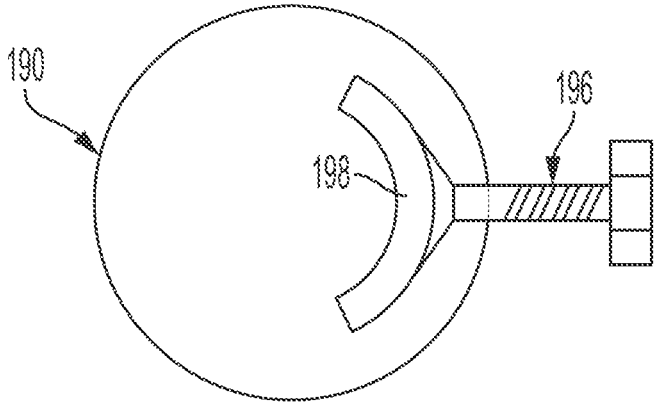
FIG. 19 illustrates a top view of the example connector of FIG. 18.

FIG. 18 illustrates a perspective view of another example connector 190 configured to be arranged on the pedestal 104 and configured to accept a foot of the laundry appliance 102. FIG. 19 illustrates a top view of the example connector 190 of FIG. 18. The connector 190 may be formed integrally with the top 108 of the pedestal 104 in that the connector 190 may be stamped or formed from the same piece of sheet metal as the top 108. The connector 190 may form cylindrical receptacle defining an opening 194 in the center thereof for receiving the foot of an appliance. The opening 194 may be large enough to accept feet of different shapes and sizes, so as to accommodate the feet of various makes and models of laundry appliance 102. The connector 190 may form a raised, volcano-like shape, that is stamped into the pedestal top 108. Such stamping may result in a lip forming around the upper rim of the connector 190. The connector 190 may define a tapped hole 192 on the side of the cylinder.

Referring to FIG. 19, the tapped hole 192 may be threaded and configured to receive a set screw 196. A radially curved plate 198 may be arranged at the distal end of the screw 196. The plate 198 may be configured to abut the surface of the foot to maintain the foot within the connector 190. Upon actuation of the screw, the plate 198 may move radially inwardly towards the center of the connector. In doing this, the plate 198 may engage with the foot, pressing the foot against an opposite side of the connector 190. The surface of the foot may also be pushed to rest at least partially under the lip of the connector 190. The plate 198 may thus maintain the foot in a fixed lateral position against the opposite interior surface of the connector 190, as well as a fixed vertical position under at least a portion of the lip, securing the foot to the pedestal. Because the opening 194 is large enough to receive most sizes of feet, the connector 190 and screw 196 allow for another example of a versatile connection mechanism for attaching the pedestal 104 and the laundry appliance 102.

Figure 20:
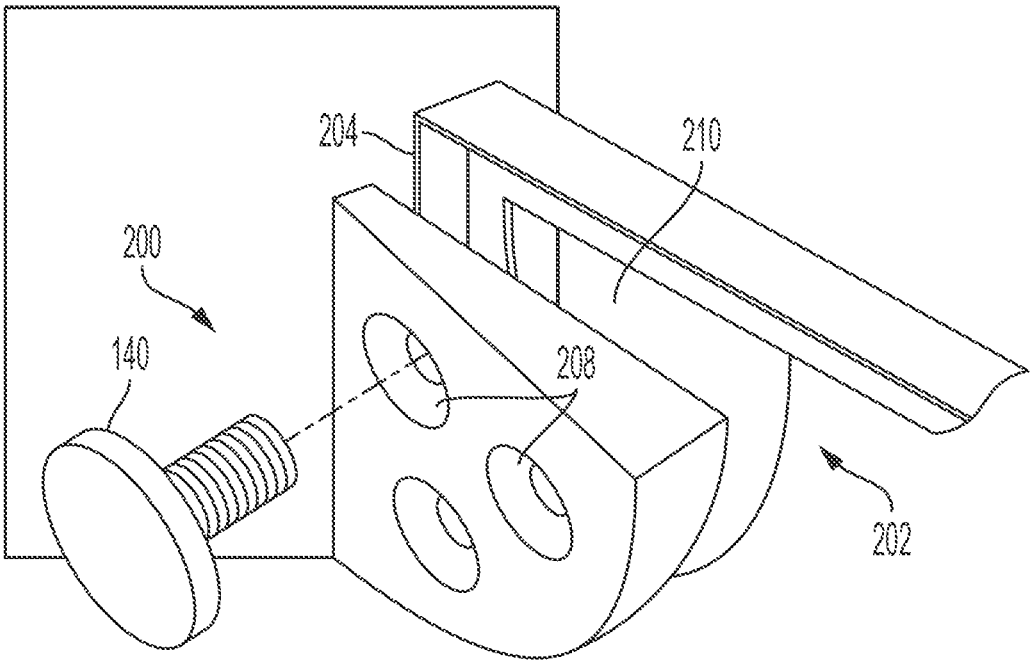
FIG. 20 illustrates a perspective exploded view of an example rubber block attachment mechanism for the pedestal.
Figure 21:
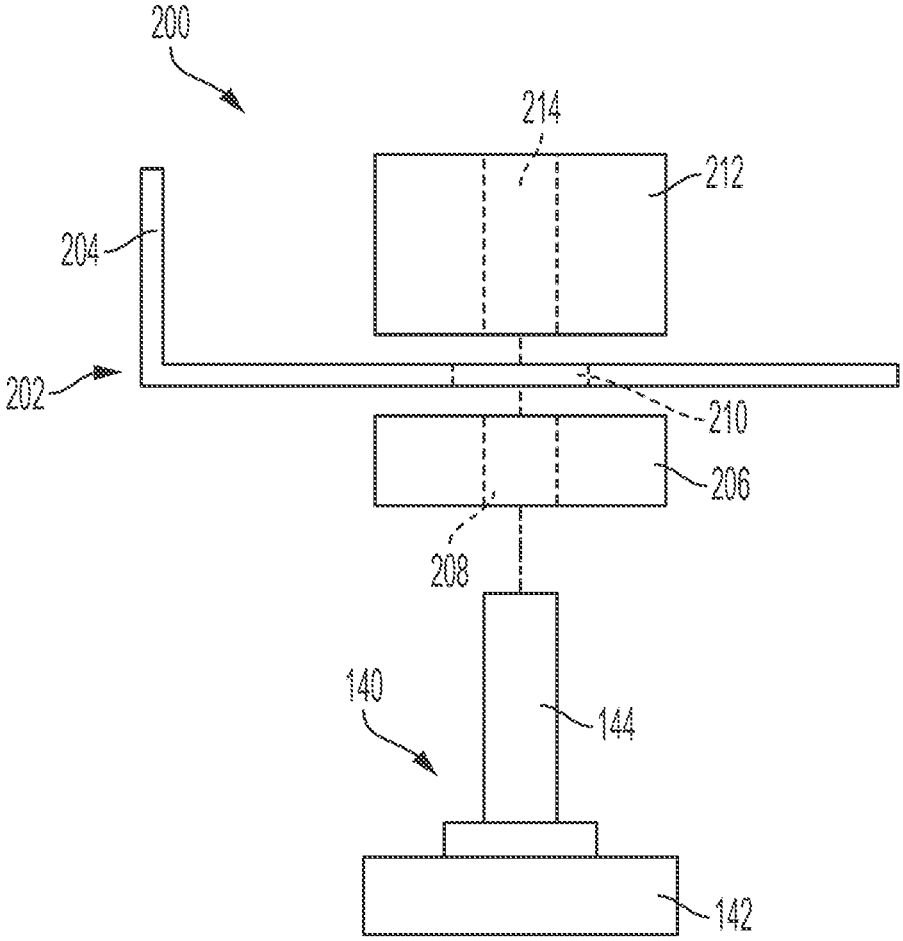
FIG. 21 illustrates an exploded side view of the example rubber block attachment mechanism.

FIG. 20 illustrates a perspective exploded view of an example rubber block attachment mechanism 200 for the pedestal 104. FIG. 21 illustrates an exploded side view of the rubber block attachment mechanism 200. In some examples, the pedestal 104 may include a drip pan 202 configured to collect any residue or moisture from the appliance above. The drip pan 202 may include a side lip 204 and may be configured to rest blow the laundry appliance 102 (not shown in FIGS. 20 and 21). The drip pan may define a drip pan opening 210.

The rubber block attachment mechanism 200 may include a first rubber block 206 arranged between the drip pan 202 and the appliance foot 140. The first rubber block 206 may define a plurality of first openings 208 configured to receive the shaft 144 of the appliance foot 140. The first openings 208 may each be arranged and sized to receive the foot of a specific model or manufacture of appliance. That is, a foot of a first make and/or model of laundry appliance 102 may be received by a first opening, and a foot of a second make and/or model of laundry appliance 102 may be received at a different opening. The first openings 208 may be marked with indicia indicated which first opening 208 corresponds to certain makes and models of laundry appliance 102. Thus, the first rubber block 206 may guide the foot 140 of a laundry appliance 102 to an appropriate location for mounting of the laundry appliance 102 to the pedestal 104.

A second rubber block 212 may be arranged between the drip pan 202 and the laundry appliance 102. The second rubber block 212 may align at or around the drip pan opening 210 of the drip pan 202 and may further define a second opening 214. The second opening 214 may be configured to receive the shaft 144 of the foot 140. Thus, during installation, the shaft of the foot may extend through one of the first openings 208, through the drip pan opening 210, and then through the second opening 214, before being screwed or otherwise secured into the laundry appliance 102.

The drip pan opening 210 may be large enough to encompass all of the first openings 208 and allow the shaft 144 to pass through the selected first opening 208 and through the drip pan opening 210. The large drip pan opening 210 allows for feet of various makes and models of laundry appliance 102 to be attached to the pedestal 104. The rubber blocks 206, 212 aid in dampening any vibrations caused by the laundry appliance 102. The rubber blocks 206, 212 may also form a water seal against the drip pan opening 210 to prevent any moisture from entering the pedestal 104. The first rubber block 206 acts as a guide or locating feature when installing the feet through the drip pan 202. Accordingly, this rubber block attachment mechanism 200 provides for various advantages including versatility amongst various makes and models of laundry appliance 102, as well as providing for dampening and sealing.

Figure 22:
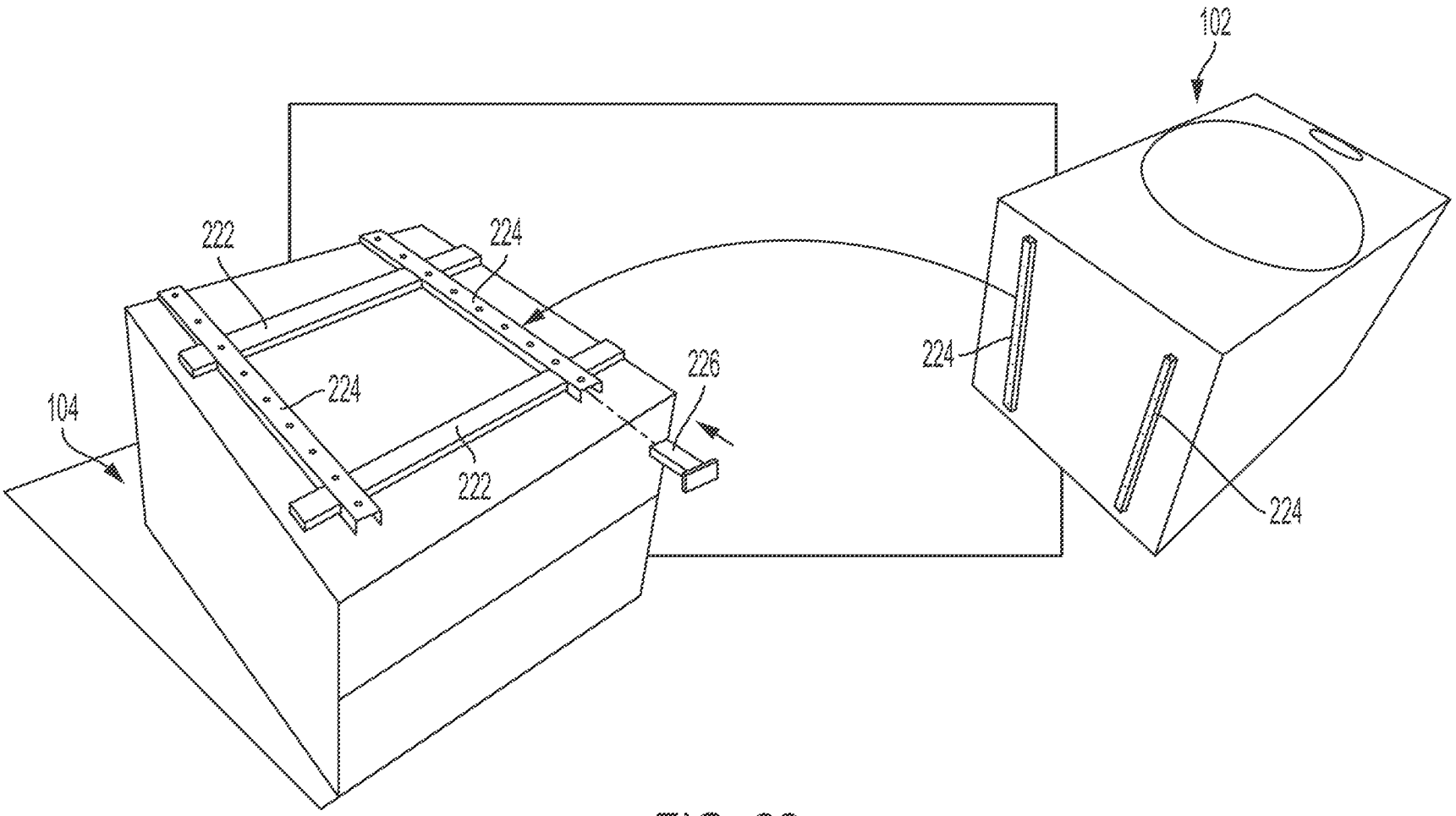
FIG. 22 illustrates a perspective view of an example rail system for attaching the laundry appliance to the pedestal.
Figure 23:
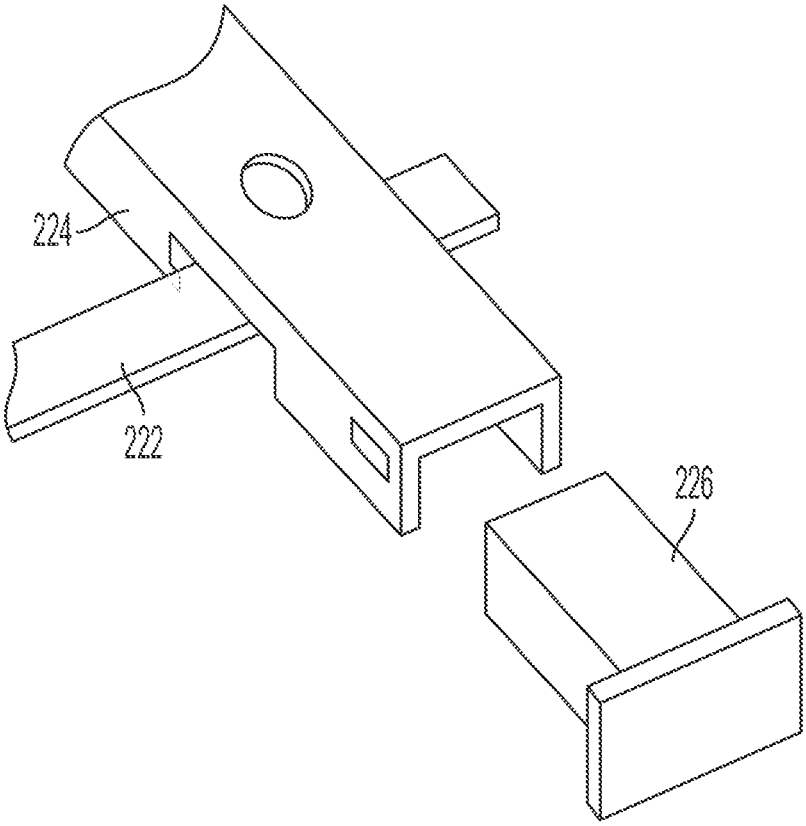
FIG. 23 illustrates a perspective view of a portion of the rail system.
Figure 24:
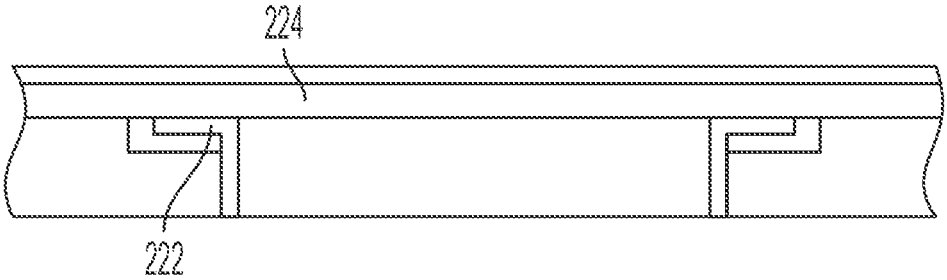
FIG. 24 illustrates a side view of a portion of the rail system.

FIG. 22 illustrates a perspective view of an example rail system 220 for attaching the laundry appliance 102 to the pedestal 104. FIG. 23 illustrates a perspective view of a portion of the rail system 220 and FIG. 24 illustrates a side view of a portion of the rail system 220. The rail system 220 includes a pair of pedestal rails 222 arranged on the pedestal 104. The pedestal rails 222 are arranged parallel to each other and extend between opposite sides of the pedestal 104 in a first direction.

A pair of appliance rails 224 are arranged on an underside of the laundry appliance 102. The appliance rails 224 are arranged parallel to each other and extend between opposite sides of the laundry appliance 102 in a second direction. The first direction is perpendicular or near perpendicular to the second direction such that the appliance rails 224 and the pedestal rails 224 extend in opposite directions. The appliance rails 224 may be mounted to the laundry appliance 102 using foot attachment points. While the rails 222, 224 are described and illustrated as including pairs, more than two rails may be included.

At least one locking block 226 is attached to either or both of the appliance rail 224 or the pedestal rail 222 to prevent movement in the first direction. That is, once the rails 224 are mated, the locking block 226 may be inserted at an end of at least one of the rails 222, 224 to aid in preventing movement thereof. Further, the appliance rail 224 may define an opening 228 to receive a screw or other form of securing mechanism to further attach the rails to laundry appliance 102. Additional screws may aid in attaching the rails 222, 224 together to maintain them in a fixed relationship with respect to one another.

In another example and although not shown, the rails 222, 224 may extend in the same first direction so as to slide with respect to one another. Once the rails have been mated, likely while the laundry appliance 102 is resting on its side or back, the locking block 226 may be inserted into an end of one of the rails 222, 224 to prevent any additional lateral movement or sliding.

The rails 222, 224 may include lips or flanges as part of their mating features to further prevent vertical movement of the laundry appliance 102 with respect to the pedestal 104.

Figure 25:
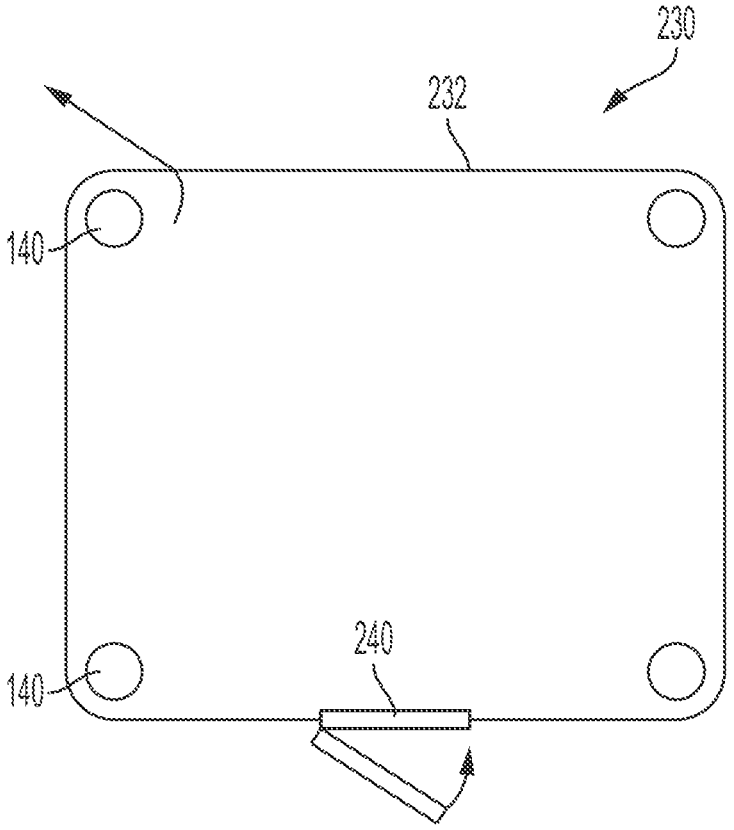
FIG. 25 illustrates a top view of an example belt attachment mechanism.

FIG. 25 illustrates a top view of an example belt attachment mechanism 230. Once the laundry appliance 102 is placed on the pedestal 104, the appliance feet 140 may rest on the top 108 of the pedestal 104. The belt attachment mechanism 230 may include a belt or strap 232 configured to form a continuous loop around the appliance feet 140. A ratchet 240 may be fixed to the strap at the front side of the laundry appliance 102 and may be configured to tighten the strap 232 in response to actuation at the ratchet 240. By tightening the strap 232, a pull force on the feet 140 is created and increased as the strap 232 is tightened. The pull force may prevent side to side movement of the feet 140.

Prior to installation of the strap 232, the strap may be loosened to sit around the footprint of the foot placement prior to the laundry appliance 102 being placed on top. Although not shown, a stop may be arranged at the interior side of the feet 140 to create a biasing force against the feet 140 opposite the pull force. This may further secure the feet 140 from lateral movement.

Figure 26:
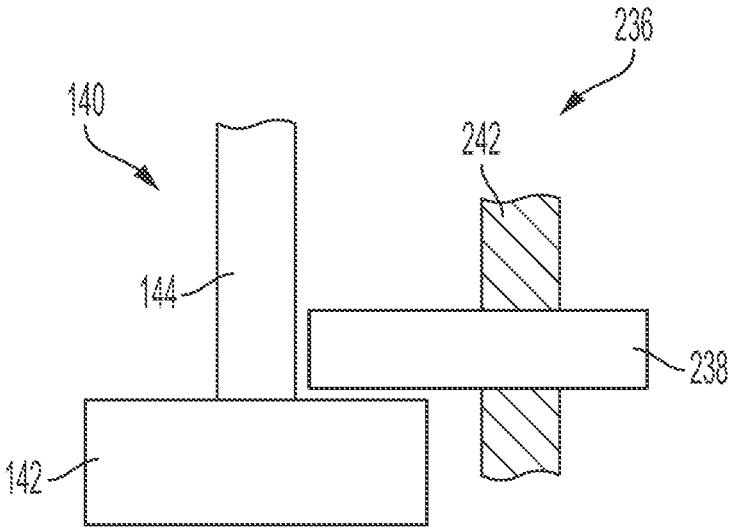
FIG. 26 illustrates a partial side view of an example appliance foot and a worm gear assembly having a worm gear arranged on a threaded shaft.

FIG. 26 illustrates a partial side view of an example appliance foot 140 and a worm gear assembly 236 having a worm gear 238 arranged on a threaded shaft 242. The worm gear assembly 236 may be arranged adjacent to the foot 140. The threaded shaft 242 of the worm gear assembly 236 may engage with the worm gear 238 via the threads. The worm gear 238 may be a disk-like shape and may include a recess around the disk to maintain the strap 232 thereon.

The strap 232 may cause the gear 238 to rotate about the threaded shaft 242. As the gear 238 rotates, the gear 238 may engage with the threads on the shaft 242 and move vertically up and down the shaft 242. Typically, as the strap 232 is tightened, the gear 238 may move downward on the shaft. The gear 238 may then come into contact with the base 142 of the foot 140 to aid in maintaining the foot 140 on the pedestal 104.

Once the gear 238 abuts the feet, the strap 232 may be unable to be tightened further. This tension may be felt at the ratchet 240 and thus give the user feedback that the strap 232 is sufficiently taut. Because the gear 238 engages the foot 140 from its top, a specific sized gear 238 is not necessary and may be universal to all feet shapes. Further, because the ratchet 240 tightens until no longer necessary, the various feet locations do not matter. The strap 232 may engage any arrangement and dimensions the feet. Thus, this screwless system is easily installed and prevents horizontal and lateral movement of the feet with a simple actuation at the front of the laundry appliance 102.

Figure 27:
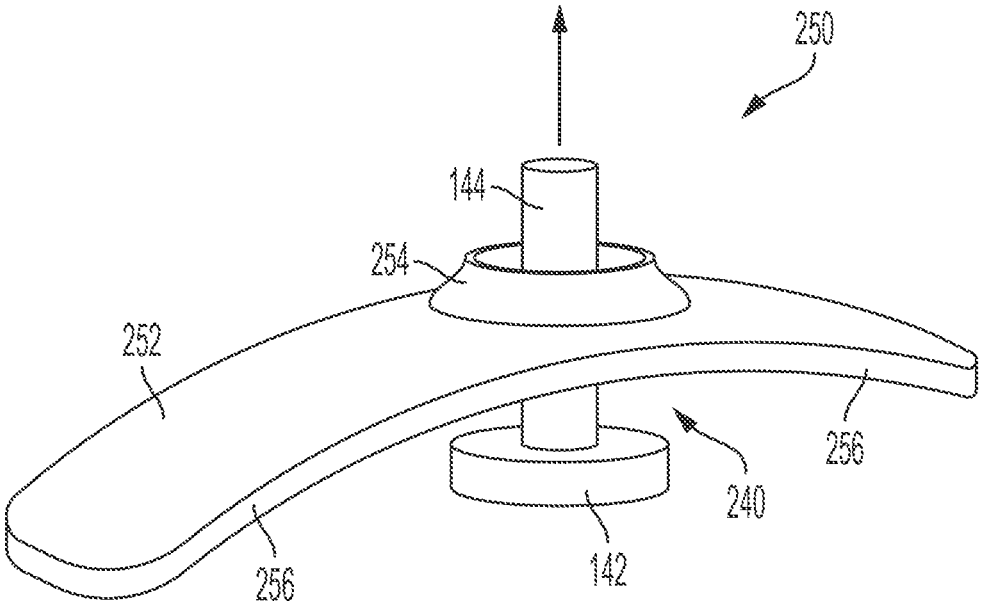
FIG. 27 illustrates a perspective view of an example strap attachment mechanism for attaching the laundry appliance to the pedestal.
Figure 28:
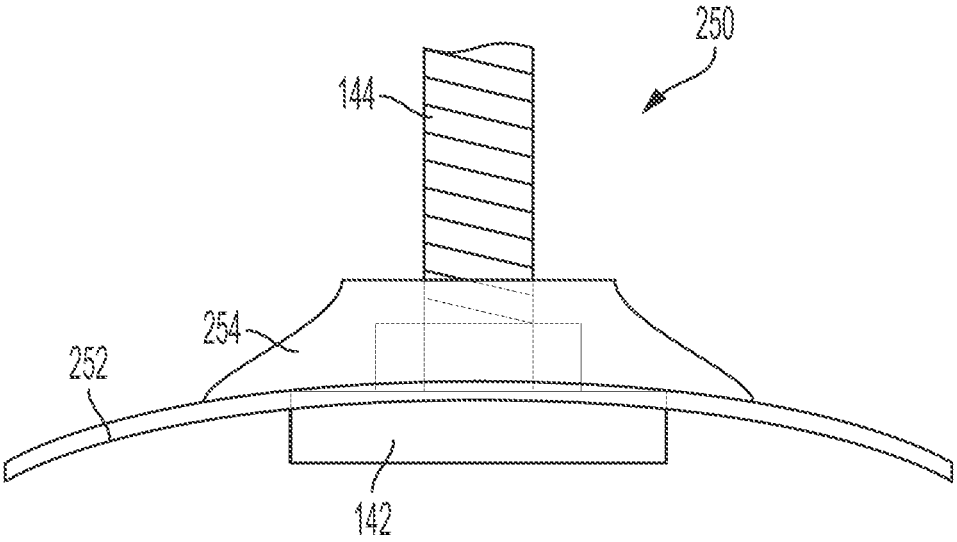
FIG. 28 illustrates a side view of the strap attachment mechanism.
Figure 29:
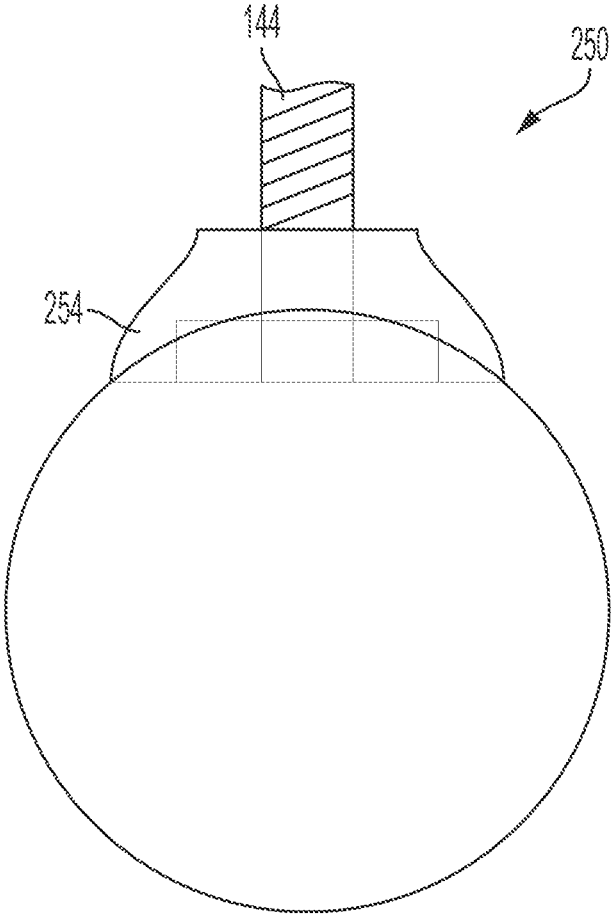
FIG. 29 illustrates another side view of the example strap attachment mechanism.

FIG. 27 illustrates a perspective view of an example strap attachment mechanism 250 for attaching the laundry appliance 102 to the pedestal 104. FIG. 28 illustrates a side view of the strap attachment mechanism 250. FIG. 29 illustrates another side view of the strap attachment mechanism 250.

The strap attachment mechanism 250 may include a tether strap 252 having a grommet 254 defined at or near the center of the strap 252. The grommet 254 may define an opening configured to receive the shaft of the foot 140 of the laundry appliance 102. The grommet 254 may be made of rubber and may be configured to be received by a portion of the laundry appliance 102. This is best illustrated in FIG. 29. Additionally or alternatively, the grommet may be received by an opening in a drip pan of the laundry appliance 102. The rubber material and round shape may aid in preventing leaks from the drip pan.

The strap 252 attaches directly to the pedestal 104 with an attachment mechanism 256, such as Velcro, snap, or a sheet metal screw. In some examples, more than one attachment mechanism may be included. The strap 252 may be made of a flexible material such as a bendable thermoplastic (e.g., nylon), or the like.

During installation, the foot 140 may be unscrewed from the laundry appliance 102. The strap 252 may be placed over the foot 140 and the shaft 144 of the foot may extend through the grommet 245. The shaft 144 of the foot 140 may then be inserted through the drip pan and screwed into the laundry appliance 102. The grommet 245 may create the seal against the opening in the drip pan. The strap 252 may then be attached to the pedestal 104 via the attachment mechanisms 256. While the strap 252 is illustrated as having a rectangular shape, other shapes, such as circular, square, etc., may be implemented. Further, the grommet 254 is shown as being located centrally within the strap 252 but may be offset from the strap center. This may be the case, in an example, where the feet 140 are arranged closer to the edge of the top 108 of the pedestal 104.

Figure 30:
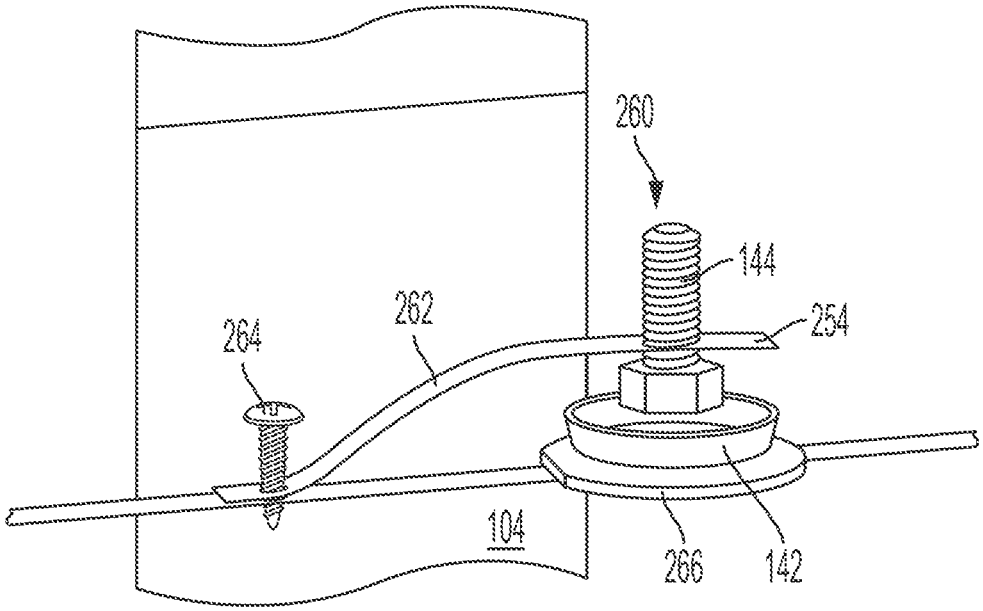
FIG. 30 illustrates a perspective view of another example strap attachment mechanism for attaching the laundry appliance to the pedestal.
Figure 31:
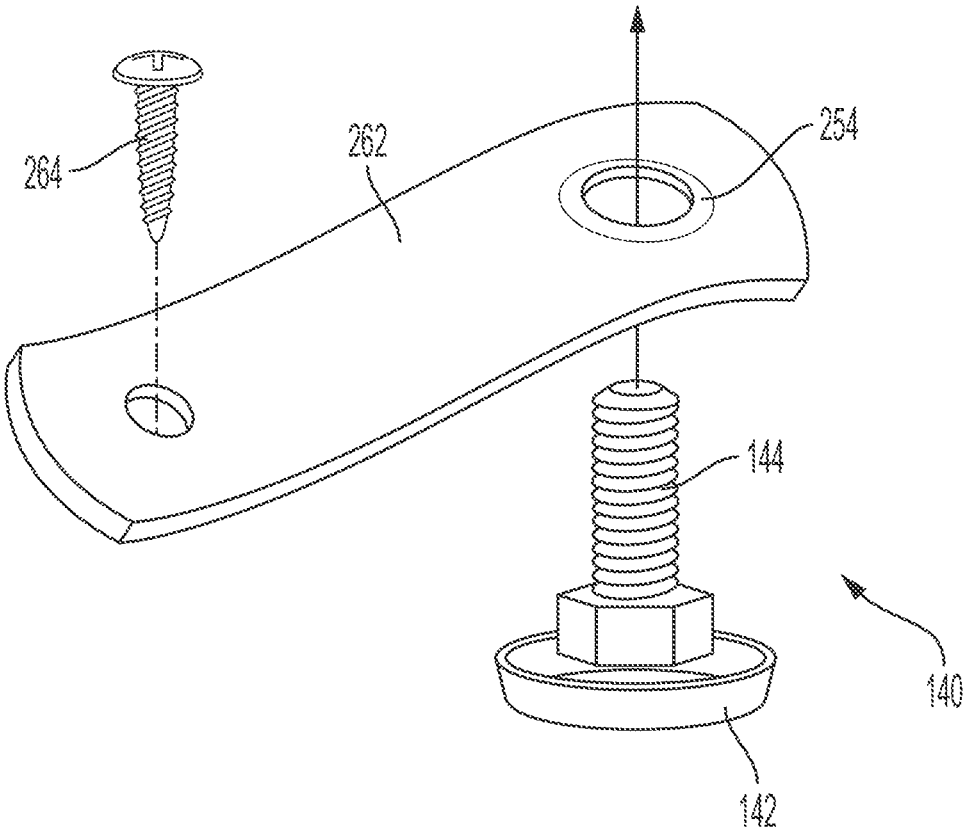
FIG. 31 illustrates an exploded perspective view of the example attachment mechanism of FIG. 30.

FIG. 30 illustrates a perspective view of another example strap attachment mechanism 260 for attaching the laundry appliance 102 to the pedestal 104. FIG. 31 illustrates an exploded perspective view of the example strap attachment mechanism 260 of FIG. 30. The strap attachment mechanism 260 may include a strap 262 similar to the strap 252 illustrated in FIGS. 27-29. In this example, the grommet 254 may be offset from the center of the strap 262. The strap 262 may be attached to the pedestal via a screw mechanism 264.

Similar to the previous example, during installation, the foot 140 may be unscrewed from the laundry appliance 102. The strap 262 may be placed over the foot 140 and the shaft 144 of the foot may extend through the grommet 245. The shaft 144 of the foot 140 may then be inserted through the drip pan and screwed into the laundry appliance 102. The strap 252 may then be attached to the pedestal 104 via the screw mechanism 264.

The top 108 of the pedestal 104 may define a notch 266 configured to receive the base 142 of the foot 140. This notch 266 may be a shallow indentation that aids in retaining the foot 140 therein. The notch 266 may aid in keeping the foot 140 atop the pedestal 104 during high vibration cycles of the laundry appliance 102.

Figure 32:
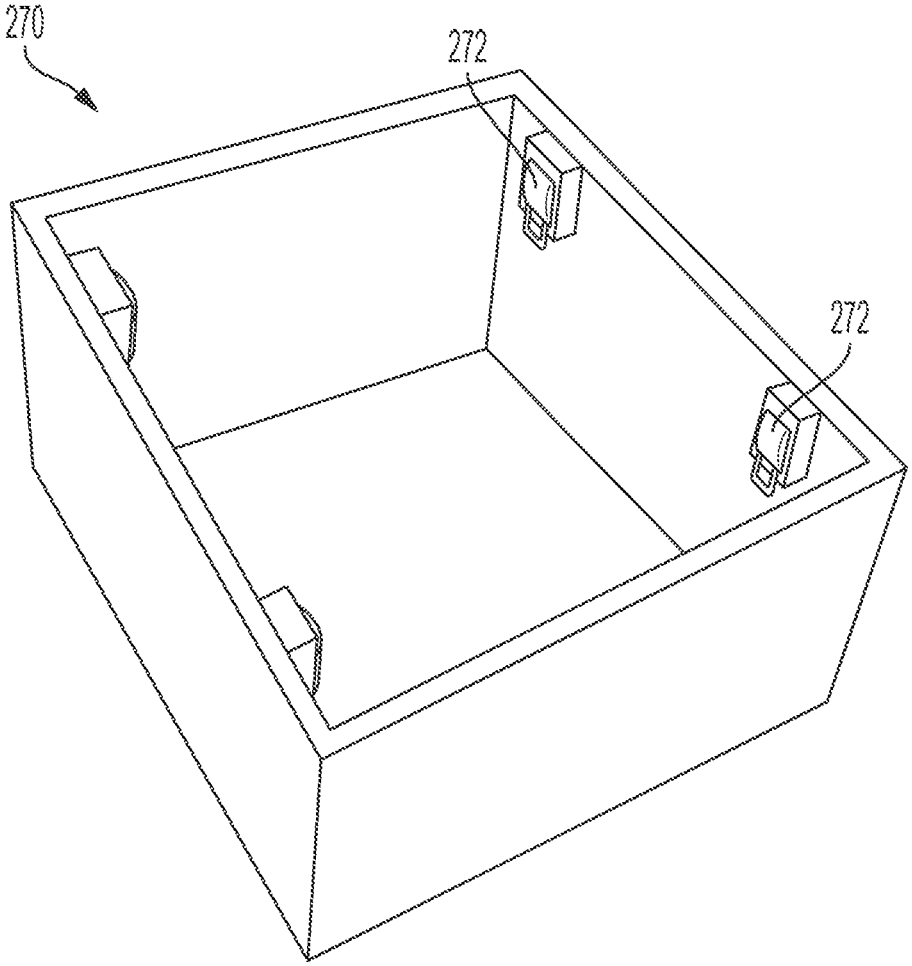
FIG. 32 illustrates a perspective view of an example pedestal having attachment mechanisms on the inside thereof.
Figure 33:
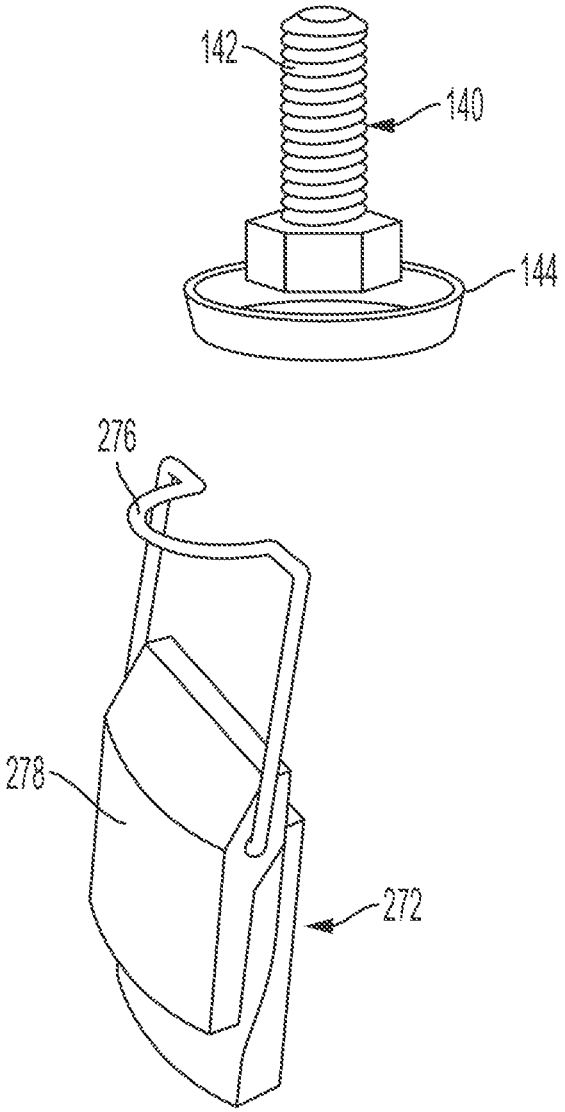
FIG. 33 illustrates a perspective view of the example attachment mechanisms and the appliance foot.

FIG. 32 illustrates a perspective view of an example pedestal 270 having attachment mechanisms 272 on the inside thereof. FIG. 33 illustrates a perspective view of the example attachment mechanisms 272 and the appliance foot 140.

The attachment mechanisms 272 may be arranged at the inner periphery of the pedestal 104 and be configured to align with a foot of a laundry appliance 102 arranged above the pedestal 104. In the example shown, two attachment mechanisms 272 are arranged at each side and towards the corners of the pedestal 270. The attachment mechanism 272 may be an adjustable draw latch configured to clasp onto the appliance foot 140 and maintain the foot 140 on the pedestal. A top panel is not shown but may be arranged on the box-like example shown in FIG. 32. The top panel may have notches or openings at the locations of the attachment mechanisms 272 in order to allow the latch to extend out of the interior of the pedestal 270 to attach to the foot 140 while the foot 140 predominately rests on the top panel.

The attachment mechanism 272 may include a latch 276 or hook mechanism with a draw lever 278. The draw lever 278 may drive the latch 276. In a released position, the latch 276 may be raised from within the pedestal 104 to engage the base 142 of the foot 140. Once the latch is in place, the draw lever 278 may be pulled down to tighten the latch 276 around the foot 140. The draw lever 278 may lock in the latched position and secure the latch 276 to the foot 140. While four attachment mechanisms 272 are illustrated, more or fewer attachment mechanisms 272 may be included. The latch 276 allow for easy installation without the need for additional tools. The latch 276 also allows for various foot locations and simplifies the process of attachment and disassembly.

Figure 34:
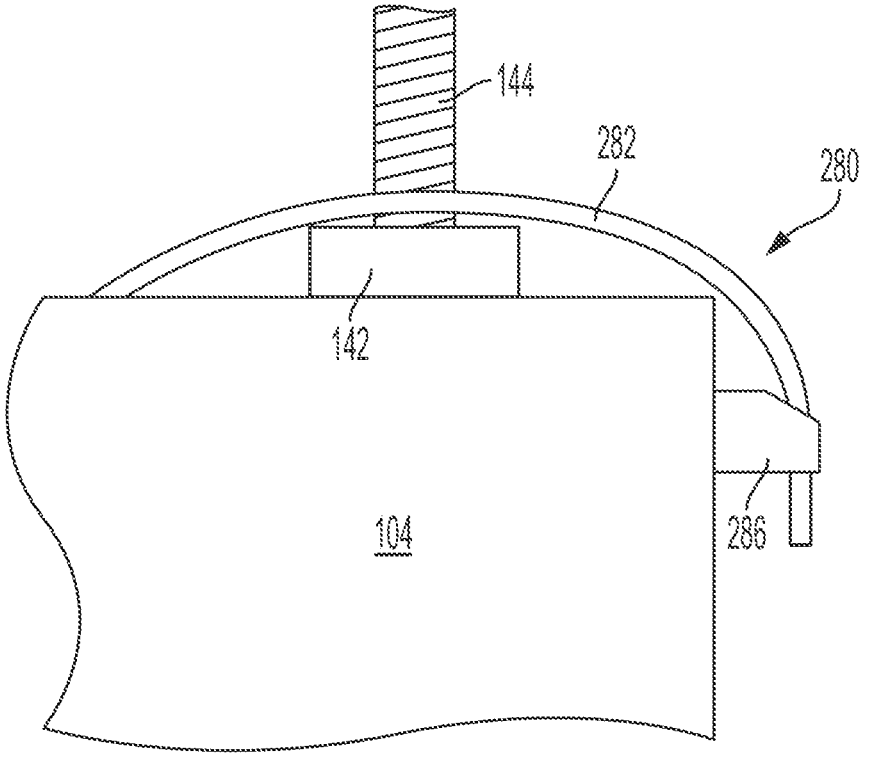
FIG. 34 illustrates a side view of an example rubber latch mechanism for securing the appliance foot to the pedestal.
Figure 35:
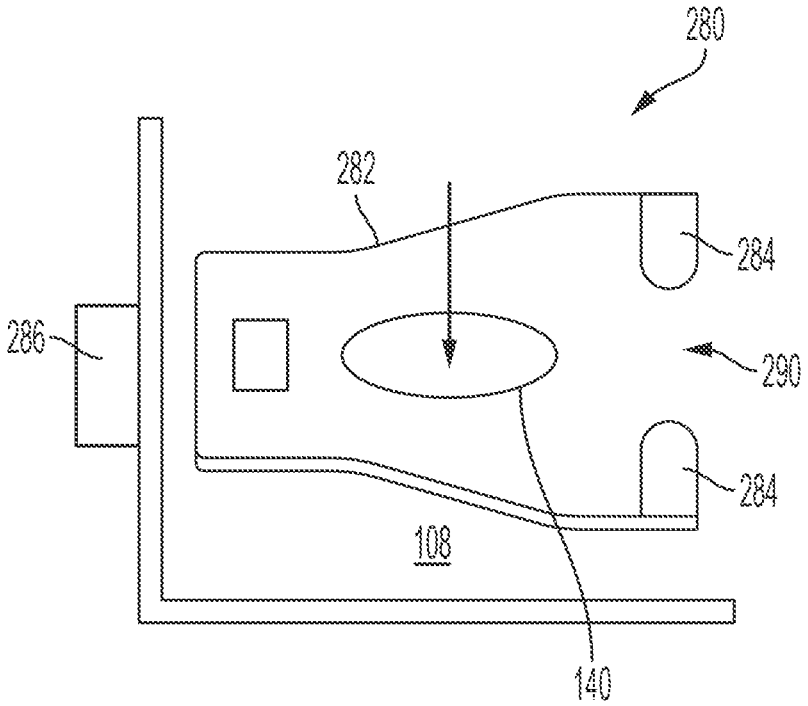
FIG. 35 illustrates a top view of the example rubber latch mechanism of FIG. 34.

FIG. 34 illustrates a side view of an example rubber latch mechanism 280 for securing the appliance foot 140 to the pedestal 104. FIG. 35 illustrates a top view of the example rubber latch mechanism 280 of FIG. 34.

The rubber latch mechanism 280 includes at least one rubber strap 282 having two ends 284, each secured to the top 108 of the pedestal 104. The two ends 284 may be attached at an apex 290 and attached generally adjacent to one another as illustrated in FIG. 35. The strap 282 may form a loop with an opening in the middle configured to receive the foot 140. The strap 282 may be made of rubber, or another material firm enough to prevent side to side and up and down movement of the foot 140, but flexible enough so that it may be pulled by a user.

A hook or eyelet 286 is arranged on the side of the pedestal 104 adjacent to the strap 282. The eyelet 286 is configured to receive the strap 282 at a portion opposite of the two ends 284.

During installation, the foot 140 of the laundry appliance 102 may be threaded through the loop created by the strap 282 and arranged on the top 108 of the pedestal. The strap 282 may then be pulled over the base 142 of the foot 140 so that a portion of the strap 282 is arranged on each side of the shaft 144. The strap 282 may then be pulled over the side of the pedestal 104 to engage and hook on the eyelet 286 arranged on the side of the pedestal 104. The strap 282 may then be pulled taut over the base 142 of the foot 140 on either side of a shaft 144 to secure the foot 140 from movement with respect to the pedestal 104.

Because the strap 282 is flexible, the strap 282 may receive any size and shape of foot 140, thus making another versatile attachment mechanism to be used with various manufacturers. Further, the rubber latch mechanism 280 may be placed on nearly any pedestal 104 at nearly any location to accommodate the footprint of differently shaped laundry appliances 102. This mechanism does not require any screws.

Figure 36:
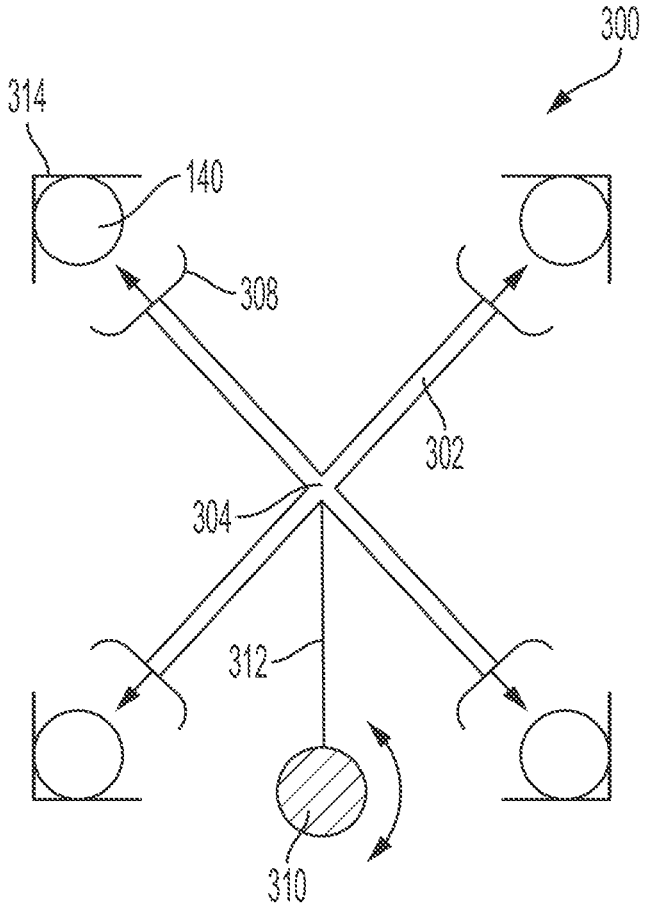
FIG. 36 illustrates a top view of an example compression mechanism for securing the appliance foot to the pedestal.

FIG. 36 illustrates a top view of an example compression mechanism 300 for securing the appliance foot 140 to the pedestal 104. The compression mechanism 300 includes a set of supports 302 extending radially outwardly from a center apex 304. In the example shown in FIG. 36, the compression mechanism 300 includes four supports 302, one corresponding to each foot 140. The supports 302 may be telescoping supports having adjustable lengths. The supports 302 may form an "x" shape. A grip 308 may be arranged at the distal end of each support 302. The grip 308 may have a crescent-like shape configured to abut the appliance foot 140. The base 142 of the foot 140 may fit in the crescent shape of the grip 308.

The compression mechanism 300 may be arranged generally centrally on the top of the pedestal 104. A knob 310 may be attached to the supports 302 at the center apex 304 via linkages 312. The knob 310 may be accessible from the front of the laundry appliance 102 to allow a user to easily access the knob 310. Upon rotation of the knob 310, the supports 302 extend radially outwardly to apply force via the grip 308 on the feet 140.

Corner brackets 314 may be arranged at each of the corners of the pedestal 104. The corner brackets 314 may be made of a material such as sheet metal or plastic, and may be configured to abut the foot 140 at a side opposite of the grip 308. The corner brackets 314 may be spring loaded. Upon rotation of the knob 310, the grips 308 push the feet 140 into the corner brackets 314 so that the feet 140 are wedged and held between the grips 308 and the corner brackets 314 to prevent movement of the laundry appliance 102 with respect to the pedestal 104. A user may continue to rotate the knob 310 until the feet 140 are pressed between the corner brackets 314 and the grips 308. Once sufficiently wedged, the corner brackets 314 may provide enough biasing force to provide feedback at the knob that the supports 302 cannot be extended further.

Thus, by rotating an easily accessible knob, each of the feet 140 may be secured, securing the laundry appliance 102 to the pedestal. The spring-loaded corner brackets 314 and the force applied by the supports 302 may compress the feet 140 therebetween and prevent vertical and horizontal movement.

Figure 37:
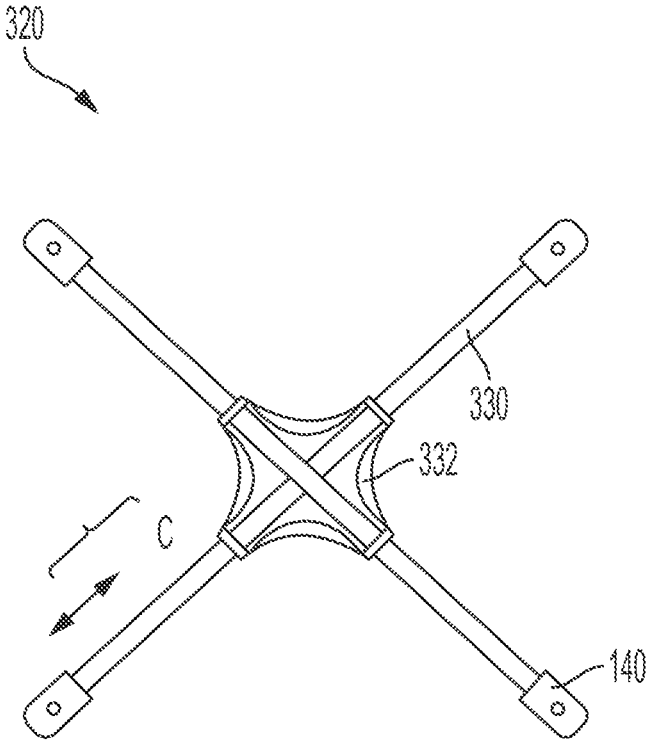
FIG. 37 illustrates a bottom view of an example x-connector for securing the laundry appliance to the pedestal.
Figure 38:
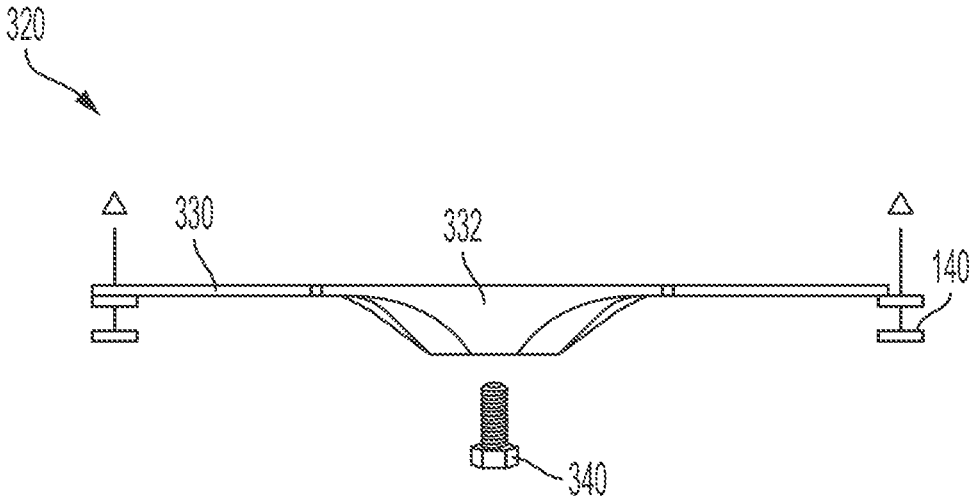
FIG. 38 illustrates a side view of the x-connector of FIG. 37.

FIG. 37 illustrates a bottom view of an example x-connector 320 for securing the laundry appliance 102 to the pedestal 104. FIG. 38 illustrates a side view of the x-connector 320 of FIG. 37. The x-connector 320 may include a plurality of supports 330. In the example shown in FIG. 37, the x-connector 320 includes four supports 330, one corresponding to each corner of the laundry appliance 102. The supports 330 may be telescoping supports having adjustable lengths. The supports 330 may form an "x" shape and extend from a central hub 332 or body portion.

The supports 330 may be pivotably attached at a proximal end at the hub 332. The distal end of the supports 330 may be configured to locate the feet 140 arranged on the underside of the laundry appliance 102. The supports 330 may be attached to the laundry appliance 102 at the feet locations. In one example, the shafts 144 of the feet 140 may extend through an opening at the distal end of the support prior to being screwed into the underside of the laundry appliance 102.

Because the supports 330 are extendable, as well as pivotable at the hub 332, the supports 330 may easily swivel and lengthen to reach each corresponding foot 140, regardless of the foot placement. That is, the angles and lengths of the supports 330 can be adjusted allowing the supports 330 to be moved to reach the respective foot 140, regardless of the make or model of the laundry appliance 102.

A screw 340 may be used to attach the hub 332 to the laundry appliance 102. This allows for a single attachment point on the laundry appliance 102 and eliminates unnecessary tools and screws being used to attach to the x-connector.

Figure 39:
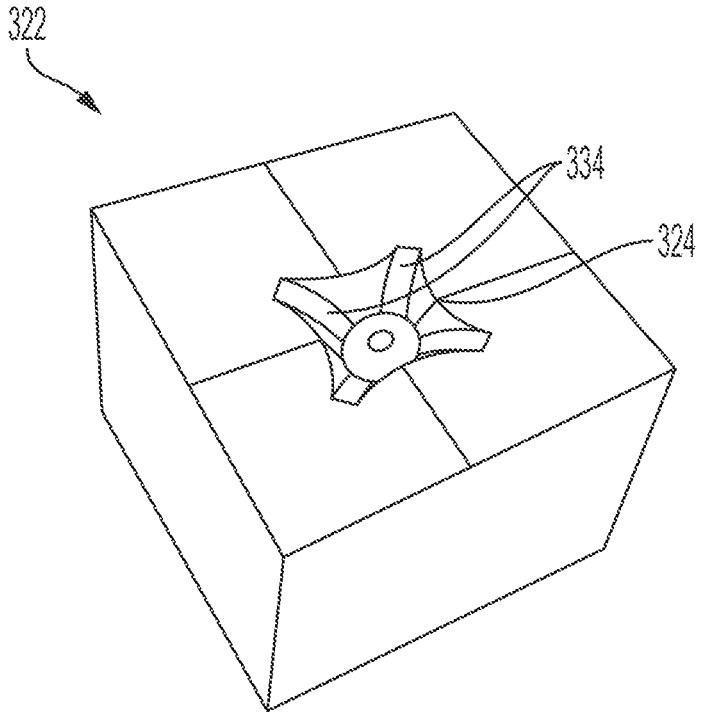
FIG. 39 illustrates a perspective view of a pedestal assembly having an example pedestal connector.

FIG. 39 illustrates a perspective view of a pedestal assembly 322 having an example pedestal connector 324. The pedestal connector 324 may attach to the pedestal 104 at a single central attachment point, allowing for easier and more universal installation. The pedestal connector 324 is configured to attach to the x-connector 320. The pedestal connector defines a plurality of openings 334 configured to secure and receive at least a portion of each of the supports 330 of the x-connector 320 in an installed state.

Figure 40:
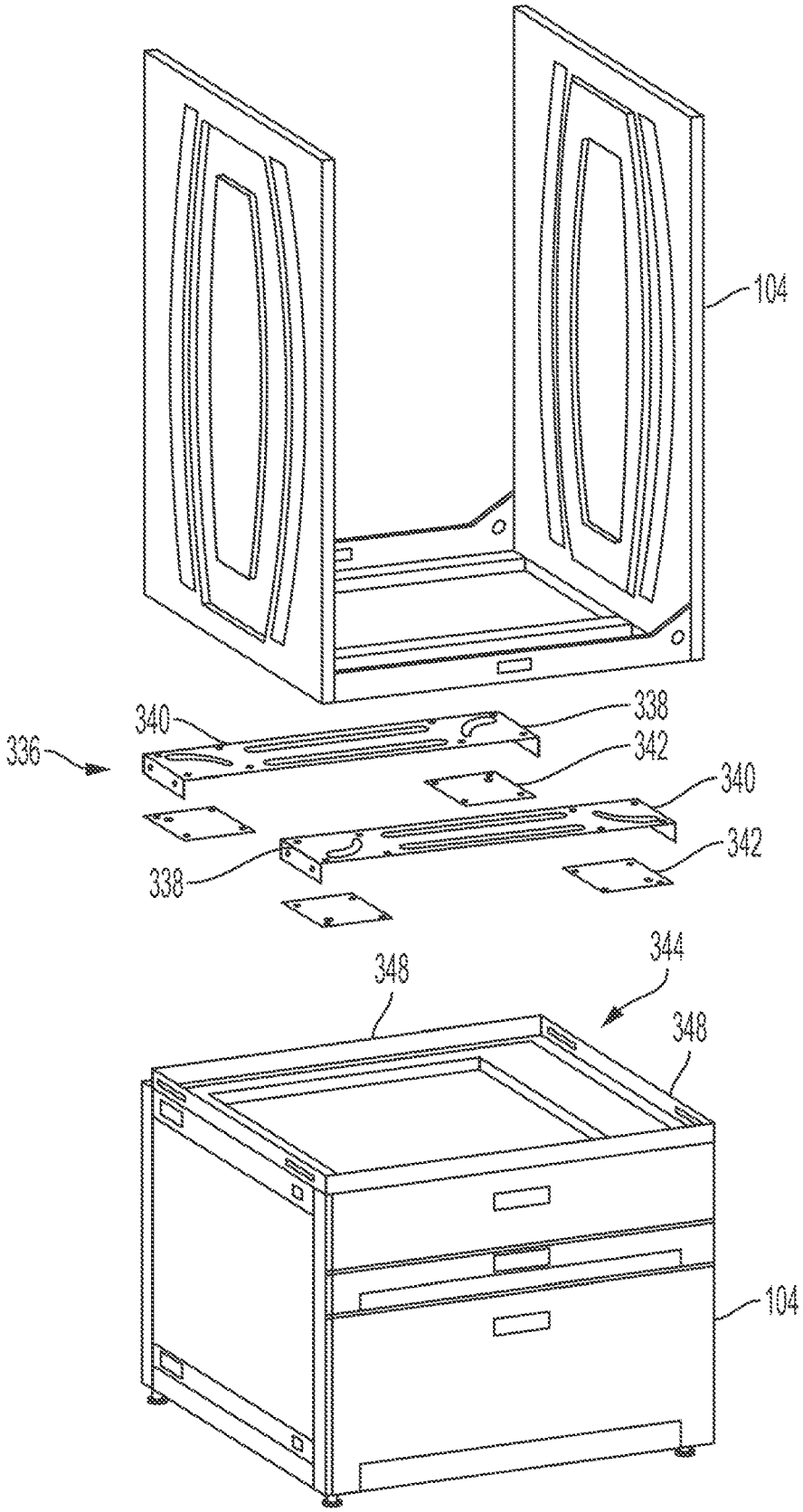
FIG. 40 illustrates a perspective exploded view of a pedestal assembly and laundry appliance having an example pedestal connector.
Figure 41:
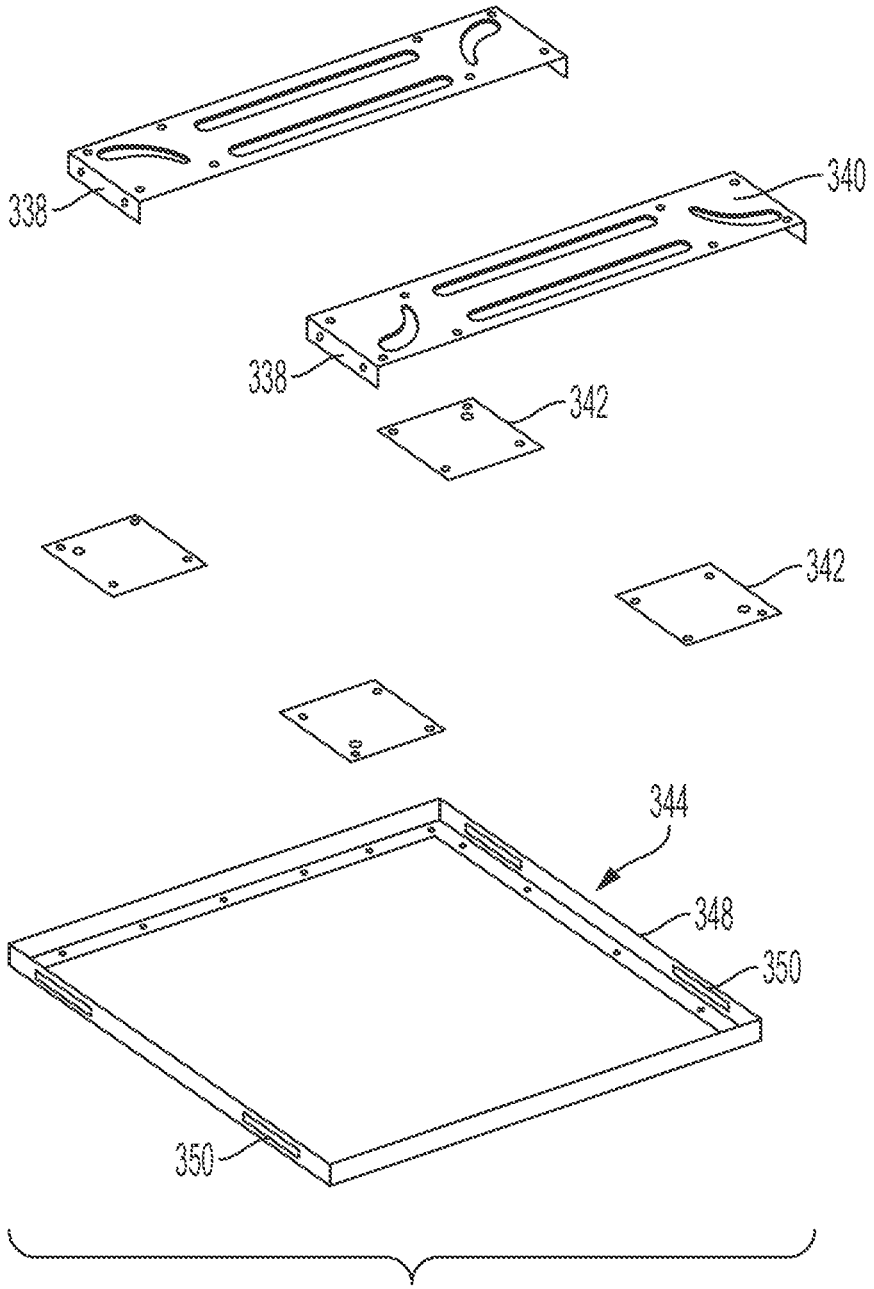
FIG. 41 illustrates a perspective exploded view of the example pedestal connector of FIG. 40.
Figure 42:
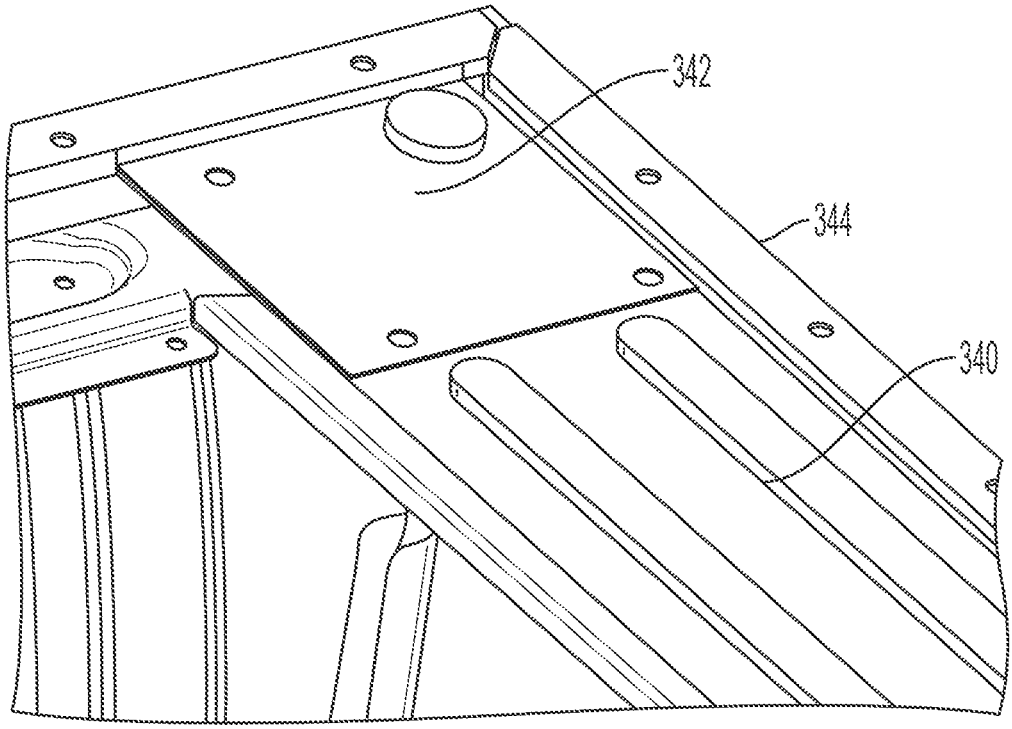
FIG. 42 illustrates a close-up bottom view of the pedestal connector of FIG. 40 in an installed state.

FIG. 40 illustrates a perspective exploded view of a pedestal assembly 104 and laundry appliance 102 having an example pedestal connector 336. FIG. 41 illustrates a perspective exploded view of the example pedestal connector 336 while FIG. 42 illustrates a close-up bottom view of the pedestal connector 336 an installed state. The pedestal connector 336 includes a pair of appliance brackets 340 configured to attach to the bottom of the appliance 102 on opposite sides. The appliance brackets 340 may be generally parallel to each other and extend along the outer sides of the appliance 102. However, the appliance brackets 340 may be arranged inward of the outer sides of the appliance 102 in an alternative arrangement. The appliance brackets 340 may be made of sheet metal, or plastic, or other materials configured to have rigid characteristics.

As best seen in FIGS. 40 and 41, the appliance brackets 340 may include lips 338 at each distal end. The lips 338 may extend downward away from the appliance 102 when the appliance brackets 340 are arranged on the bottom of the appliance 102. Each lip 338 may include at least one opening configured to receive a fastener such as a screw. The lips 338 may form a corner at each of the appliance brackets 340. The appliance brackets 340 may have a greater length than width, as the length extends the enter footprint of the appliance 102.

A foot bracket 342 may be arranged at each of the four corners of the appliance 102 at the end of the appliance brackets 340 such that one end of the foot bracket 342 abuts the lip 338 of the appliance bracket 340. The foot brackets 342 may be square shaped, or near square shaped, having a similar width as that of the appliance bracket 340. The foot brackets 342 may be specific to the manufacturer of the appliance 102. That is, different openings for the feet may be configured differently based on the placement of a specific appliance's feet, which often vary from manufacturer to manufacture. The appliance brackets 340, on the other hand, may be configured to adapt for multiple manufactures. The openings to receive the feet on the appliance bracket may be larger, more generic, and configured to receive feet at multiple locations on the pedestal 104. The foot bracket 342 may be manufacture specific with smaller and less openings so as to maintain rigidity of the bracket.

The connector 336 may include a cross bracket 344 arranged on the pedestal 104. The cross bracket 344 may include four sides 348 and be configured to extend around the perimeter of the top of the pedestal 104. The cross bracket 344 may be attached to the pedestal 104 by screws, bolts, etc. Each side 348 may define at least one opening 350 (as best seen in FIG. 41). In the example shown in FIGS. 40-42, a pair of openings 350 may be defined on two opposite sides 348. Thus, each corner of the cross bracket 344 may include at least on opening. These openings may be configured to receive a connector, such as a screw, and align with the lip 338 of the appliance bracket 340.

During installation, the appliance 102 may be rested on its side. The appliance feet (not shown in FIGS. 40-42), may be removed. The foot brackets 342 may be attached to ends of each of the appliance brackets 340. These may be attached via screws, bolts, etc. In one example, the brackets 340, 342 may be attached using at least four fasteners. The appliance feet may then be installed through a foot opening defined by the brackets 340, 342 and screwed into the bottom of the appliance 102.

The cross bracket 344 may be attached along the permitter of the pedestal 104. As explained, this may be done using screws, etc., through openings in the cross bracket 344. In some examples, these openings may be configured to align with corresponding screw openings on the pedestal 104. Further, the cross bracket 344 may include multiple openings configured to align with other corresponding screw openings on various pedestals. That is, the cross bracket 344 may be "keyed" for attachment to various manufacturers' pedestals, without the need for manufacturer specific brackets 344.

Once the foot brackets 342, appliance brackets 340, and feet, are installed on the underside of the appliance 102, the pedestal 104 may then be "hung" on the appliance 102 by placing the cross bracket 344 onto the appliance and foot brackets 340, 342. The lips 338 of the appliance bracket 340 may fit within the cross bracket 344. The openings in the lips 338 may align with the openings 350 of the sides 348 of the cross bracket 344. The appliance bracket 340 and cross bracket 344 may then be fastened together at least at each corner via a fastener. In one example, the fastener may include a weld nut and screw. The lip 338 and the cross bracket 344 may form a snug fit with each other so as to prevent movement of the appliance bracket 340 within the cross bracket 344. In one example, the fasteners may be installed, but not completely tightened to allow for more adjustments later.

Once the fasteners have fixed the lips 338 of the appliance bracket 340 to the cross bracket 344, the connected appliance 102 and pedestal 104 may be brought upright. The position of the appliance 102 with respect to the pedestal 104 may be adjusted to a final position and the fasteners may then be tightened to secure the appliance 102 to the pedestal 104.

Thus, a pair of appliance brackets 340 are arranged at opposite sides on the underside of the appliance 102 and extend from one edge of the appliance 102 to another. The appliance bracket 340 defines at least one opening configured to receive a shaft of the foot of the appliance and includes a lip 338 extending downward and away from the appliance 102 at the ends of the brackets to engage with a drip tray arranged on the pedestal 104. The lips 338 may define at least one aperture or opening 350 to align with an aperture of the drip tray to receive an attachment mechanism therethrough to secure the appliance bracket 340 to the drip tray of the pedestal 104. A foot bracket may be included and configured to receive the shaft of the foot and be arranged at the corners of the appliance 102 contiguous to the appliance bracket such that the appliance bracket 340 is arranged between the appliance 102 and the foot bracket 342.

This method and connector 336 allow for more universal and easier to install pedestal attachments because only one portion of the connector 336 is manufacturer specific (e.g., the foot brackets). Because of this, mass production may decrease costs associated with the other portions, and allow for easier and more standard install regardless of the manufacturer.

Figure 43:
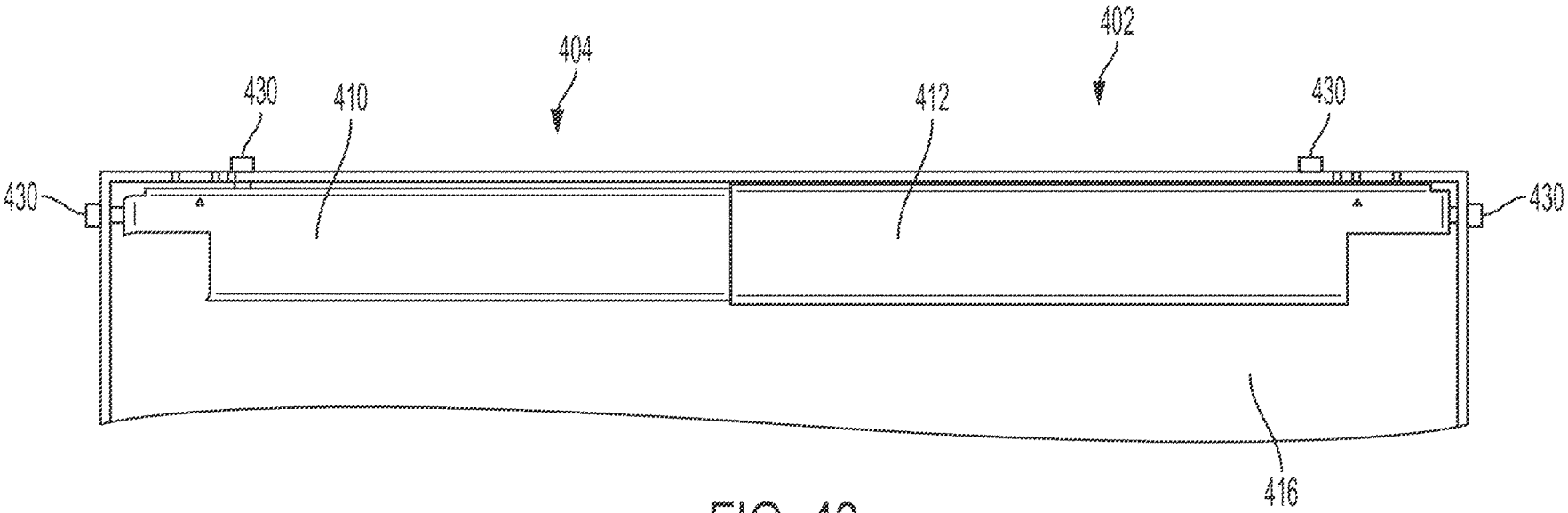
FIG. 43 illustrates a side view of a pedestal assembly having a pedestal connector.
Figure 44:
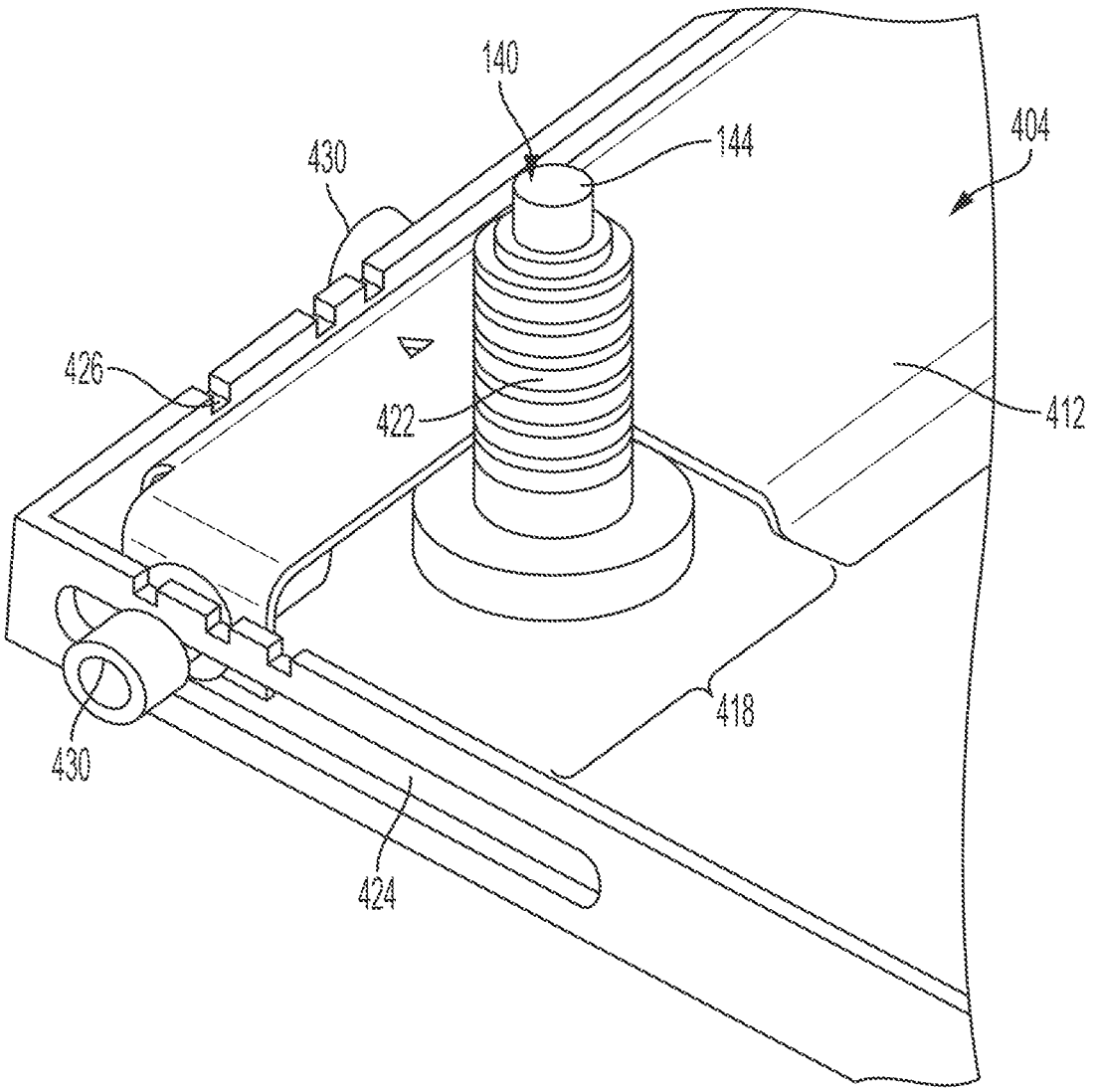
FIG. 44 illustrates a partial perspective view of the pedestal connector of FIG. 43.
Figure 45:
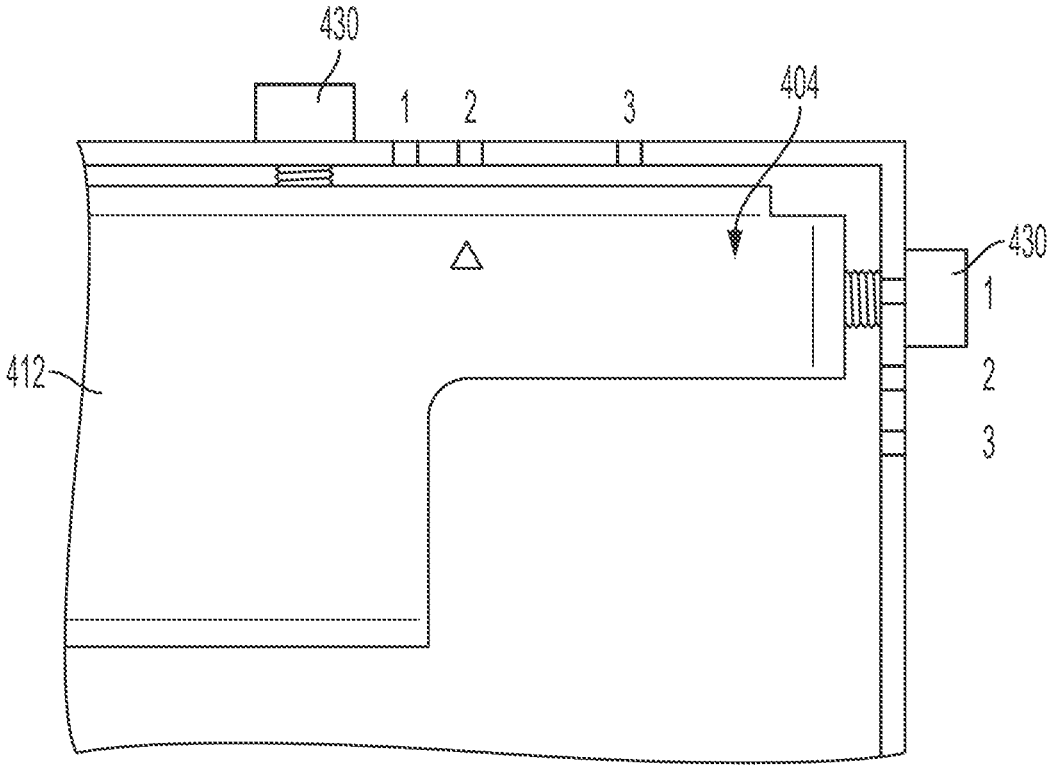
FIG. 45 illustrates a close-up partial side view of the pedestal assembly and connector of FIG. 43.

FIG. 43 illustrates a side view of a pedestal assembly 402 having a pedestal connector 404. FIG. 44 illustrates a partial perspective view of the pedestal connector 404. FIG. 45 illustrates a close-up partial side view of the pedestal assembly 402 and connector 404 of FIG. 43. The pedestal connector 404 includes at least one sliding bracket 408 having a first piece 410 configured to nest into a second piece 412. The two pieces are configured to nest and slide within the other to create a custom width to fit within a drip tray 416 arranged on a pedestal.

Each of the first and second the pieces 410, 412, may define a notch 418 (as best illustrated in FIG. 44) on the distal ends thereof to abut the shaft 144 of an appliance foot 140 in an installed position. A bushing 422 is also installed on the shaft 144 of the foot 140 and configured to receive a portion of the respective piece. The notch 418 may form an L-shape at the distal end, but other shapes may be contemplated such as a curved or semi-circular opening, each configured to engage with the shaft of the foot 140.

The pedestal connector 404 may include a plurality of fasteners 430 to place the pedestal at an appropriate notch on the pedestal. In the example shown, four fasteners 430 may be included. For example, the pedestal connector 404 may include two side notches 424 and two front notches 426. The notches 424, 426 may be defined in the lip forming the perimeter of the drip tray 416. The side notches 242 may be on opposite sides of the drip tray 416 near the corners, while the front notches 426 may be defined near the corners on the same side. Each notch 424, 426 may be configured to receive at least on fastener 430.

Once the laundry appliance is installed on the pedestal/drip tray 216, the fasteners 430 may be tightened. The fasteners 430 may move along various positions within the notches 424, 426 allowing the placement of the pedestal connector 404 to vary with various models. That is, various positions may be possible, as annotated by '1', '2', and '3', on FIG. 45. The fasteners 430 may be loosened to move along the notch 424, 426, and tightened once at the appropriate location. In some examples, the fasteners 430 may be spring loaded to bias into the tightened position, and capable of being pulled out during movement along the notch 424, 426.

During installation, the laundry appliance may be laid on its side. The feet 140 may be removed and the bushing 422 may be installed on the shaft 144. The feet 140 may be reinstalled on the appliance and tightened. The pieces 410, 412 of the pedestal connector 404 may be loosely installed to the pedestal by inserting the fasteners 430 through the notches 424, 426. The fasteners may be installed as far from the corners as the notches 424, 426 allow. The appliance may then be lifted on top of the pedestal assembly 402 positioning the feet 140 far forward as possible.

The pieces 410, 412 may be slid apart to engage and abut the feet 140 and fit within the bushings 422. The four fasteners 430 may then be tightened at the appropriate position. In practice, the pedestal connector 404 includes a pair of connectors 404, one at the font and one at the rear of the drip tray 216.

Figure 46:
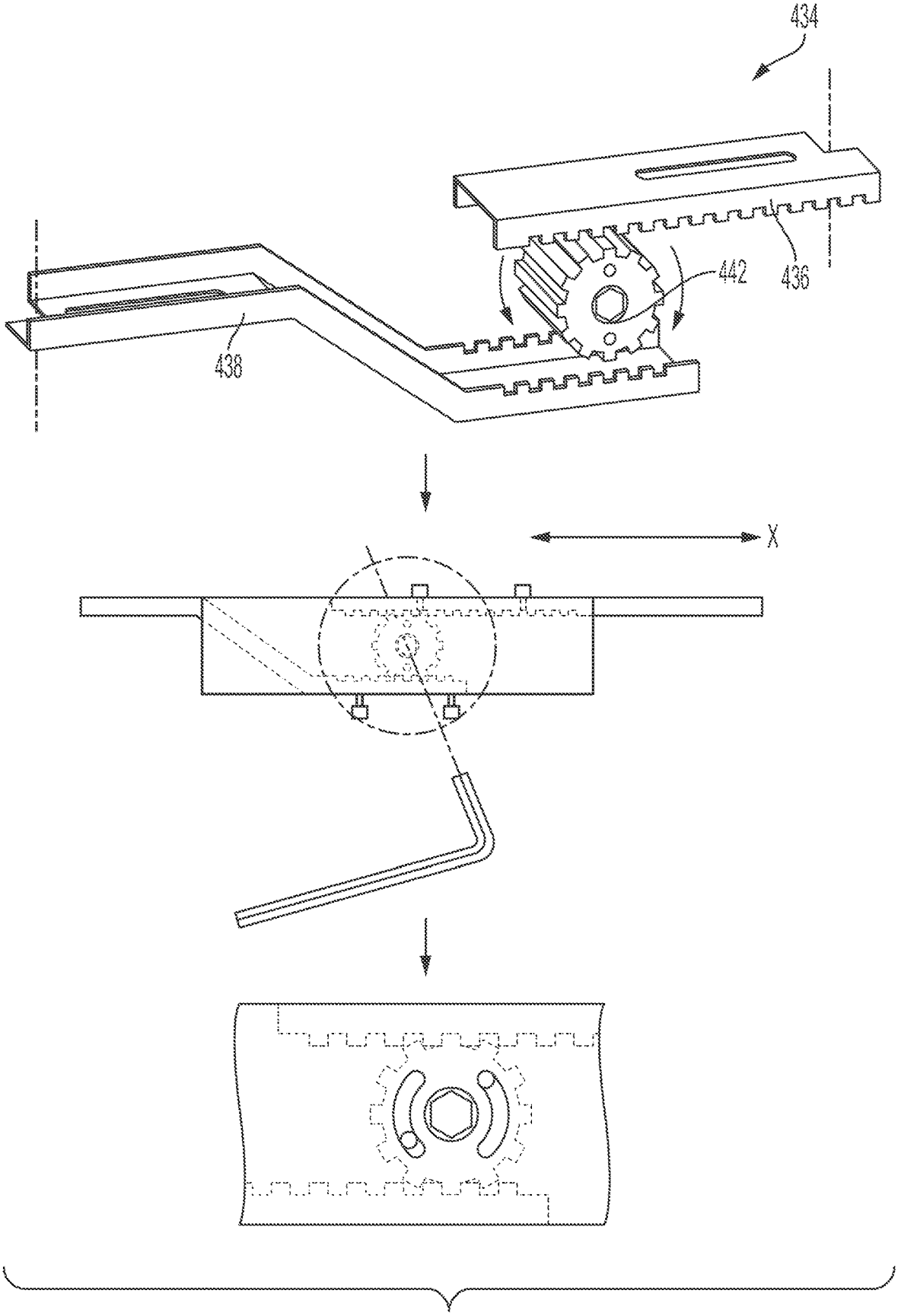
FIG. 46 illustrates a perspective view of a pedestal connector 40 having a pair of brackets.
Figure 47:
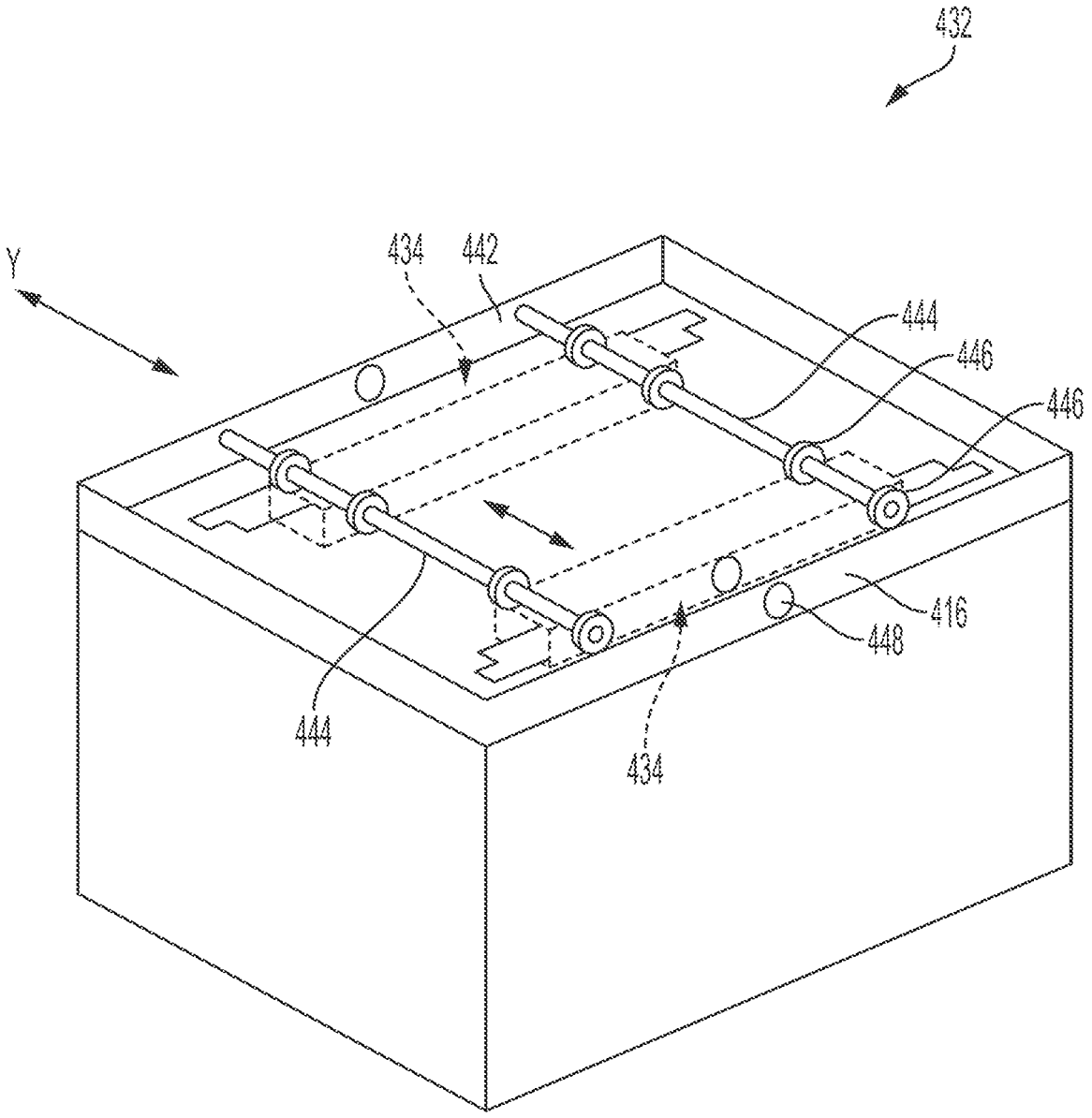
FIG. 47 illustrates a perspective view of a pedestal assembly with the connector of FIG. 47.

FIG. 46 illustrates a perspective view of a pedestal connector 440 having a pair of brackets 434. FIG. 47 illustrates a perspective view of a pedestal assembly 432 with the connector 440 of FIG. 47. While described separate from the examples in FIGS. 43-45, aspects of each of the examples may be applied to FIGS. 46 and 47. For example, the pedestal connector 404 may include a rails similar to those of pedestal connector 440.

Referring to FIGS. 46 and 47, the pedestal connector 440 may include a pair of brackets 434 having a top rail 436 and bottom rail 438 each configured to move laterally about a central gear 442. Each rail 436, 438 may define a plurality of teeth configured to interlock with the gear 442 and the rails 436, 438 may expand and retract with respect to one another to increase and decrease their combined width (e.g., the 'X' direction in FIG. 46.) The gear 442 may be rotated via an Allen wrench or other keyed tool. The gear 442 may be configured to be locked by a locking screw. All of the components may be configured to fit inside the square shell for easy shipping.

The brackets 434, as best illustrate in FIG. 47, may be spaced and parallel to one another within the drip tray 416 where the rotation of the gear 442 either retracts or expands the rails 436, 438 to provide a custom width to fit within the drip tray 416. A pair of threaded rods 444 may be configured to be arranged perpendicular to the brackets 434 and movable there along. The threaded rods 444 including a plurality of lock nuts 446 configured to secure the connector in place within the drip tray 416. Referring to the figures, the lock nuts 446 may move to lock the brackets 434 in place laterally on either side thereof. In this example configuration, all of the fasteners can be easily hidden as there will only be an opening 448 on the sides to reach the gear 442. Thus, the rails 436, 438 allow for a custom width.

Thus, an adjustable pedestal connector 440, may include at least one sliding bracket 404, 434 configured to be arranged within a drip plan on top of a pedestal 104 and including two portions 410, 412 one configured to nest and slide within the other to create a custom width to fit within the drip tray, wherein at least one of the two portions define a notch 418 on a distal end thereof to abut a shaft 144 of an appliance foot 140 in an installed and expanded position. The bushing 422 may be configured to be installed on the shaft 144 of the foot 144 to receive a portion of the respective piece at the notch 418. One of the two portions may be the top rail 436 and the other of the two portions may be the bottom rail 438, each engaged with a gear 442 arranged therebetween, where the rotation of the gear 442 either retracts or expands the rails 436, 438 to provide the custom width to fit within the drip tray.

The bottom rail or bracket 436 defines the notch or opening 418 at the distal end configured to receive the shaft 144 of the foot 140 of the appliance 102 to fix the drip tray to the appliance 102. The at least one sliding bracket 436 includes a pair of brackets spaced and parallel to one another within the drip pan. The pair of threaded rods 444 may arranged perpendicular to the brackets and movable laterally there along. The plurality of lock nuts 446 are arranged along each of the threaded rods 444 and configured to secure the connector in place within the drip pan.

This method and connector 402, 434 allow for more universal and easier to install pedestal attachments because the connector 336 is not manufacturer specific. The width and lateral location of the connector is adjustable to accommodate various feet locations, sizes, etc. Because of this, mass production may decrease costs associated with the other portions, and allow for easier and more standard install regardless of the manufacturer.

Figure 48:
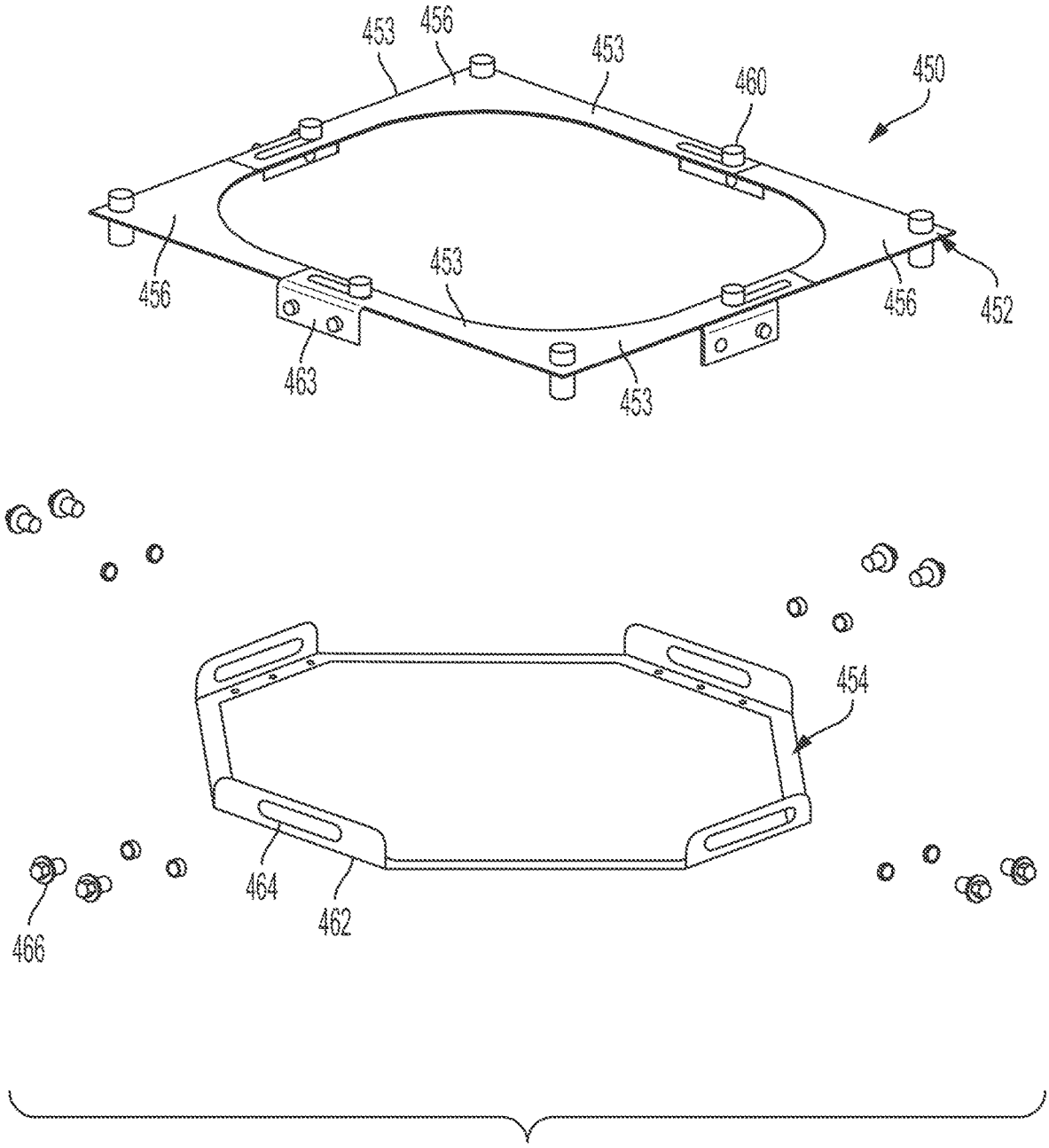
FIG. 48 illustrates an exploded view of a pedestal connector having an appliance bracket and a pedestal bracket.
Figure 49:
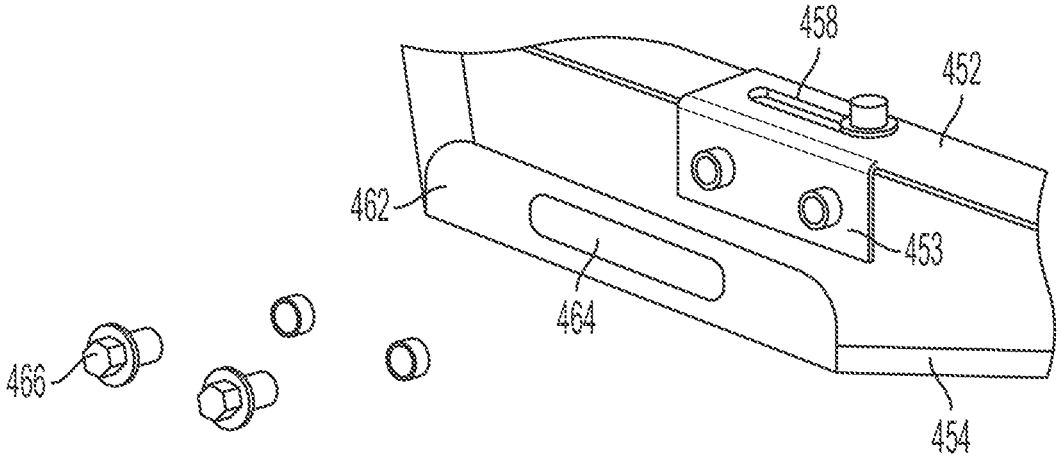
FIG. 49 illustrates a close-up perspective view of a portion of the connector of FIG. 48.
Figure 50:
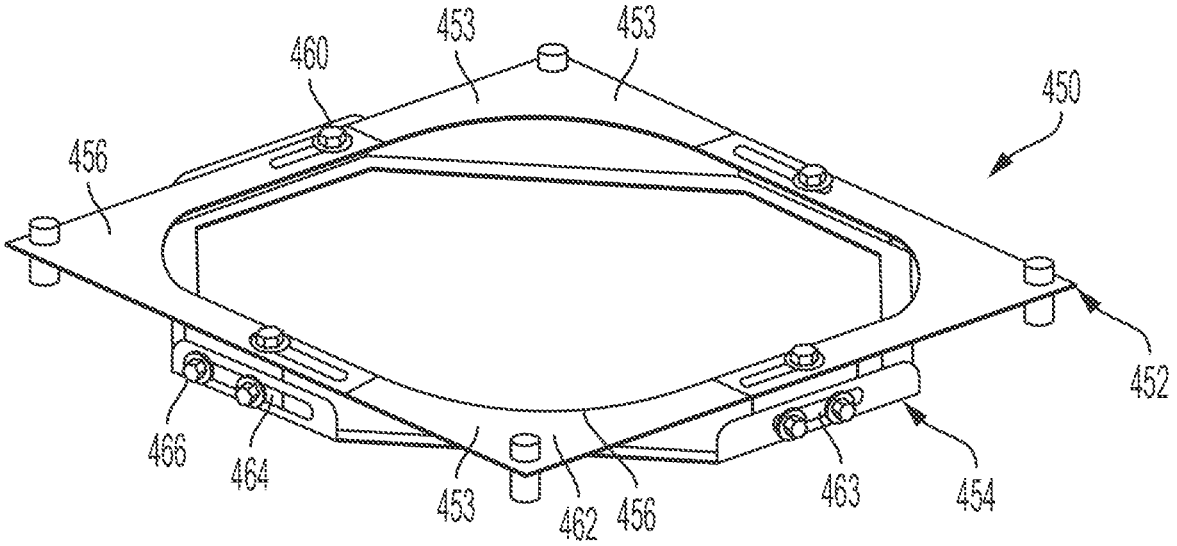
FIG. 50 Illustrates a perspective view of the connector in an installed state.

FIG. 48 illustrates an exploded view of a pedestal connector 450 having an appliance bracket 452 and a pedestal bracket 454. FIG. 49 illustrates a close-up perspective view of a portion of the connector 450 of FIG. 48. FIG. 50 Illustrates a perspective view of the connector 450 in an installed state. The pedestal bracket 545 is configured to attach to the top of a pedestal and fix to the appliance bracket 452. The appliance bracket 452 includes four corner brackets 456 configured to attach to one another to form a rectangular shape. The appliance bracket 452 may also be configured to accommodate various positions of the feet on different appliances.

The appliance bracket 452 defines includes a pair of legs 453 forming a right angle at the corners thereof, each leg defining at least one elongated slot 458 at each of the distal ends. The slots 458 are configured to overlap with an elongated slot 458 of the adjacent corner bracket 456 in order to receive a bolt 460 therein and fix the corner brackets 456 to one another. This allows the width and length of the appliance bracket 452 to be adjustable to an appropriate size for the appliance. By loosening and tightening the bolts 460, the relative position of the brackets 456 may be adjusted. Once the appliance bracket 452 is appropriately adjusted, the feet may be removed from the appliance and reinstalled through the bushings at each corner.

The pedestal bracket 454 may be preinstalled to the pedestal 104. The appliance 102, once the appliance bracket 452 is installed, may be placed on the pedestal bracket 454. The appliance may be lifted onto the pedestal, or the appliance may be installed on the pedestal while on its side. The pedestal bracket 454 may include at least one pedestal lip 462 defining an opening 464 at each side. The pedestal lips 462 may extend in a first upward direction. In the example shown, the pedestal lips 462 may include four, equidistantly spaced lips 462.

The pedestal opening 464 may be configured to align with a least one appliance lip 463 extending downward in a second direction from the appliance bracket 452 to attach the appliance bracket 452 with the pedestal bracket 454 via an attachment mechanism 466 (e.g., locking nuts). Two attachment mechanisms 466 may be used at each pedestal opening 464, for a total of 8 bolts. Bushings may be needed as spacers on the rear due to the potential gap between the brackets. The pedestal lips 462 may correspond to the appliance lips.

During installation, the appliance 102 may be laid on its side and the feet may be removed. All bolts may be loosened. The feet may be installed through spacers at each corner of the appliance bracket 452 and tightly secured to the appliance 102. The appliance bracket 452 may be sided and the bolts may be tightened through the elongated slots 458. The pedestal 104 may then be hanged or placed on the appliance bracket 452. The attachment mechanisms 466 may then be attached. In one example, a portion of the attachment mechanisms 466 may be installed while the appliance is on its side, and the remaining portion may be installed once the appliance and pedestal have been lifted. This may allow for final adjustments after the appliance has been brought upright.

Thus, the appliance bracket 452 includes four corner brackets 456 each having a pair of legs 453 forming a right angle at the corner thereof, each leg 453 defining an opening or slot 458 configured to overlap with the slots 458 of the adjacent bracket 456, wherein the slots 458 are elongated allowing for varying overlap between the adjacent legs 453 to allow for a custom length between the two corner brackets 456 to connect the two legs to fix the length of the bracket 452. The pedestal bracket 454 is configured to be arranged on a pedestal 104 beneath the appliance 102 and attach to the appliance bracket 452 to secure the pedestal 104 to the appliance 102. The pedestal bracket 454 includes four pedestal lips 462 extending in a first direction, the pedestal lips 462 being equidistantly spaced around the pedestal bracket 454. The corner brackets 456 of the appliance bracket 454 include the corner lip 463 extending in a second direction and configured to attach to at least one of the pedestal lips 462 of the pedestal bracket. Each of the pedestal lips correspond to one of the corner lips 463 in an attached configuration.

This method and connector 450 allow for more universal and easier to install pedestal attachments because at least a portion of the connector 336 is not manufacturer specific. The appliance bracket may be adjusted for various models, and have lips that overlap those of the pedestal bracket.

Figure 51:
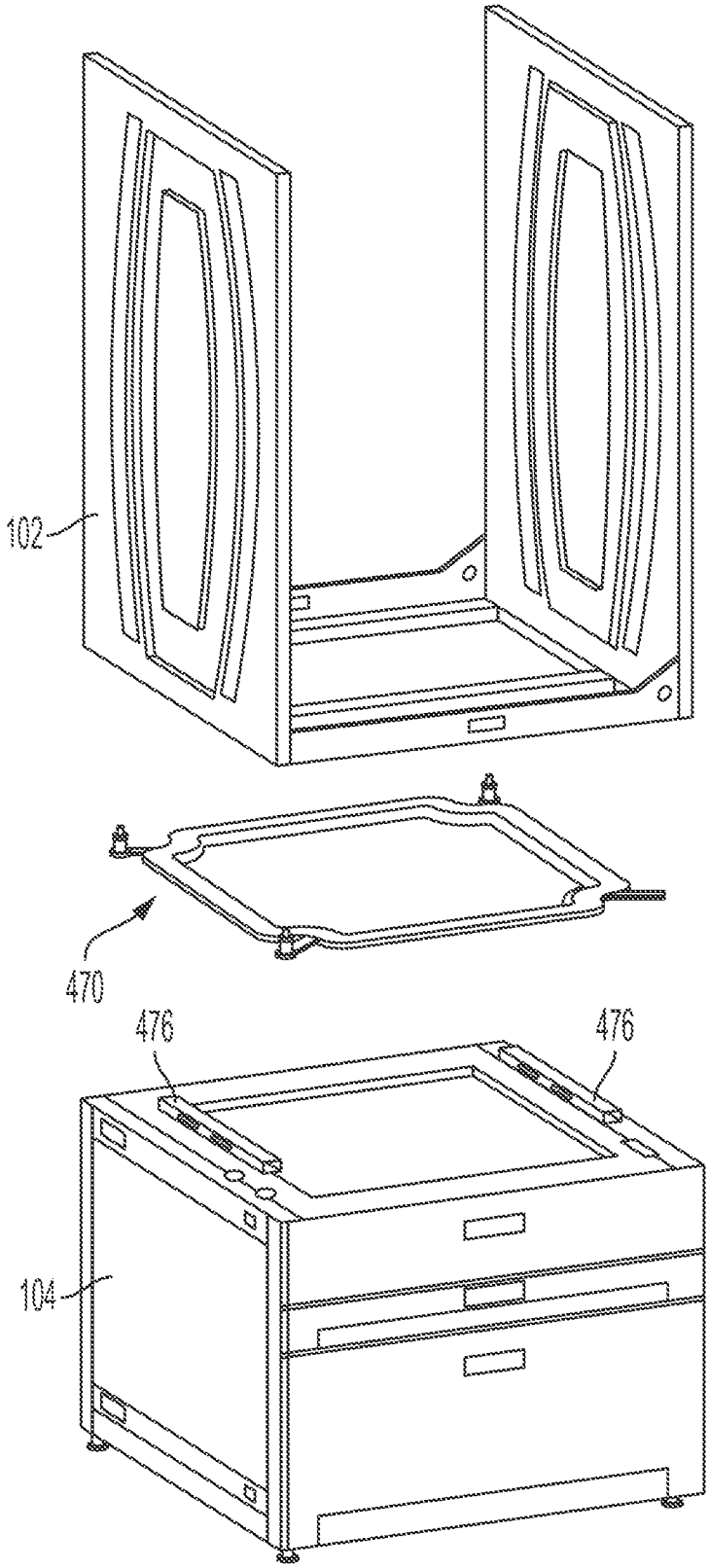
FIG. 51 illustrates a perspective exploded view of a pedestal assembly and laundry appliance having an example pedestal connector.
Figure 52:
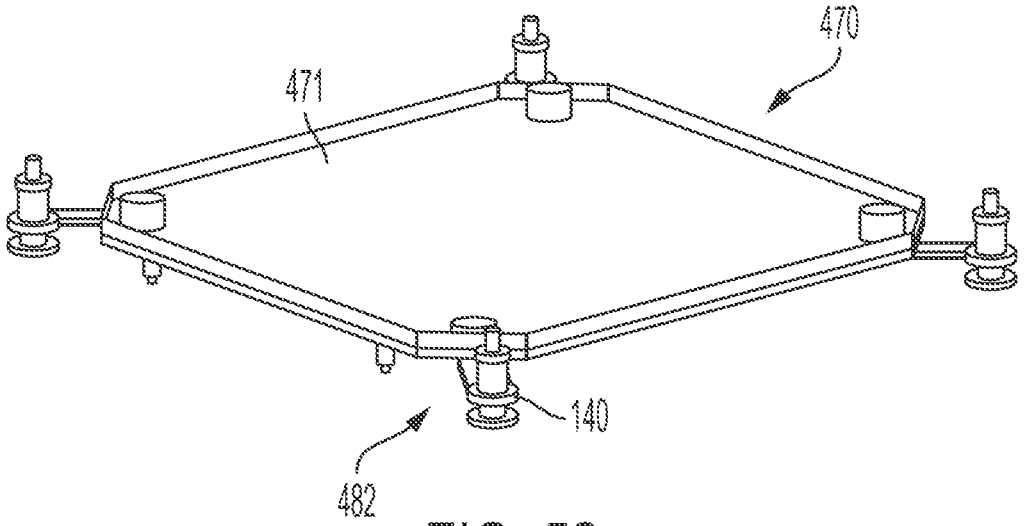
FIG. 52 illustrates a perspective view of the pedestal connector.
Figure 53:
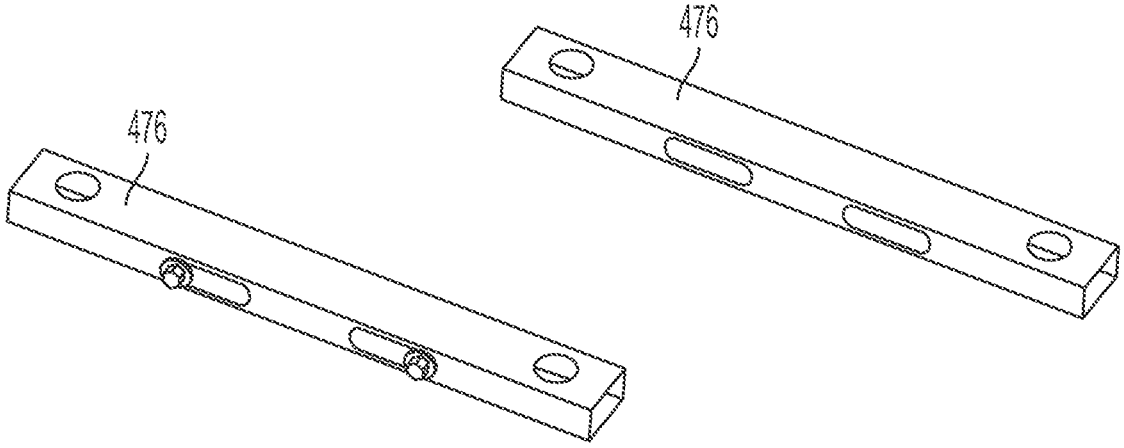
FIG. 53 illustrates a perspective view of a pair of retention rod.
Figure 54:
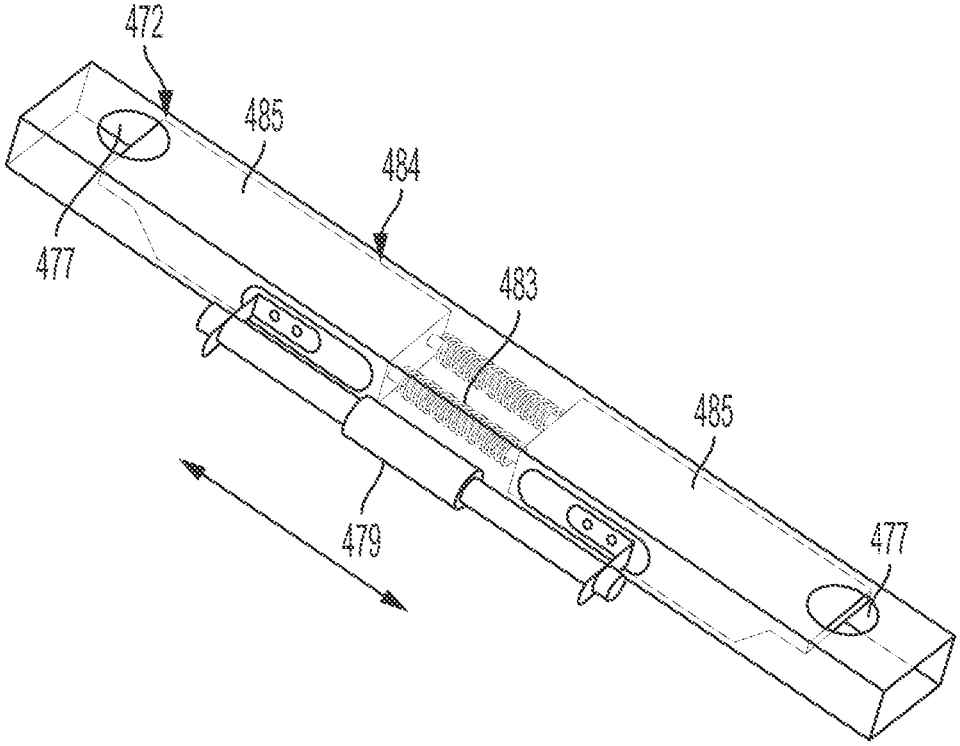
FIG. 54 illustrates a perspective view of a retention rod.
Figure 55:
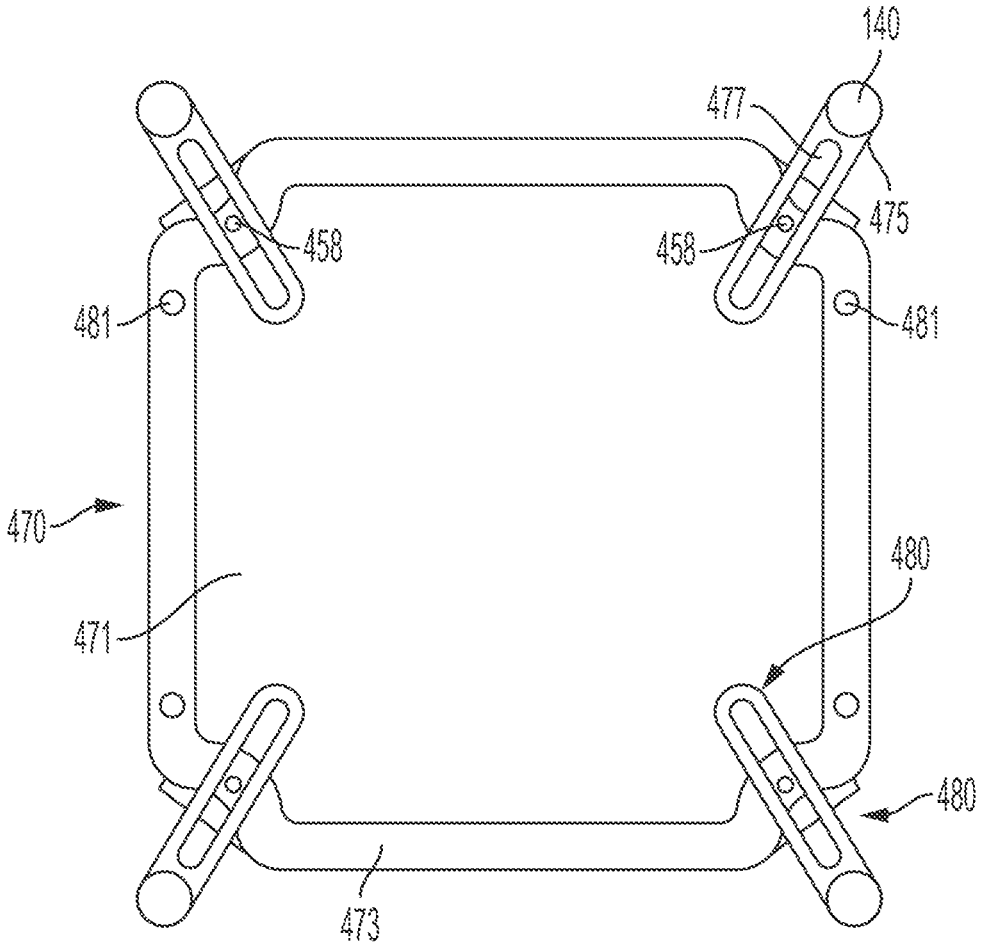
FIG. 55 illustrates a top view of the pedestal connector.

FIG. 51 illustrates a perspective exploded view of a pedestal assembly 104 and laundry appliance 102 having an example pedestal connector 470. FIG. 52 illustrates a perspective view of the pedestal connector 470. FIG. 53 illustrates a perspective view of a pair of retention rods 476. FIG. 54 illustrates a perspective view of a retention rod 476. FIG. 55 illustrates a top view of the pedestal connector 470.

The pedestal connector 470 may include an appliance base 471 and an appliance foot 140 maintained on the connector 470 via a foot bracket 480. Each of the corners of the connector 470 may include a foot bracket 480. The foot bracket 480 may include a pin 482 or attachment point, as best illustrated in FIG. 55. The foot bracket 480 may include a support 475 having an elongated slot configured to receive one or both of the pin 482 and the shaft of a foot of the appliance 102. The support 475 be radially and laterally movable. This allows the foot bracket 480 to adjust the placement of the foot 140 with respect to the connector 470. This allows for the appropriate foot position to match the bottom of the appliance 102, regardless of the size and foot position. The pin 482 may be configured to be tightened to secure the bracket 480 in a fix position once the foot has been appropriately placed. The connector 470 may also be configured to capture water thereon.

A pair of retention rods 476 may extend parallel to one another on each side of a pedestal 104 and configured to engage with the pedestal connector 470. In one example, the retention rods 476 may define an opening 477. The opening 477 is configured to receive at least one projection 481 extending downward from the connector 470 in the installed position. In the example shown in FIG. 54, the opening 477 includes a pair of openings at each end of the retention rod 472.

The retention rod 476 may include at least one biasing member 484 configured to impart force on the projection 481 in the locked position to fix the appliance 102 to the pedestal 104. For example, the biasing member 484 may include a spring 483 (or more than one spring as shown in FIG. 54) and two retention blocks 485 within the hollow interior of the retention rod 476. The spring 483 may bias the retention blocks 485 outward so that when the projection 481 is arranged within the opening 477, the retention blocks 485 abut and retain the projection 481 therein, thus securing the pedestal connector 470 with the retention rod 476. A technician may install the connector and secure the pedestal connector 470 to the retention rod 476 via a locking handle 479 arranged on the exterior of the retention rod 476. This may include a rotatable cylinder or other form of switch or dial configured to release the bias of the biasing member 484.

The pedestal 104 may be installed with the appliance 102 on its back or side. The appliance 102 may also be placed on top of the pedestal 104 for installation. The retention rods 476 may be preinstalled on the pedestal. During placement, once the appliance and the pedestal are aligned, the locking mechanism of the retention rods 476 may be turned to the locking position.

In installation, the appliance may be laid on its side the feet removed. The pins 482 may be loosened and the feet may be placed through a washer or bushing and then through the opening 477 of the support 475. The feet 140 may then be reinstalled into the appliance. Once the feet are secured to the appliance 102, the appliance 102 may be pulled up on top of the pedestal 104. The brackets 480 may be aligned with openings 477 defined in the top of the retention rods 476. The lock on the rods 476 may then be moved to the lock position to secure the appliance to the pedestal via the biasing mechanism.

The, the appliance base 471 is configured to be arranged on an underside of the appliance 102 and carries the foot bracket 480 extending from each corner thereof. Each foot bracket includes a support that is attached to the base via a pin allowing the foot bracket to be movable in each of a radial and lateral position to adjust the placement of the foot prior to the pin being tightened or locked in place. The projection 481 is arranged on an underside of the appliance base is received by the retention rod 474 attached to the pedestal to secure the pedestal 104 to the appliance 102. The rod further includes a biasing member 484 arranged therein and configured to impart force on the projection 481 to secure the pedestal 104 in the locked position.

Accordingly, an easily installable bracket system for the appliance and pedestal to be connected, either by placing the appliance on its side or back, or by lifting the appliance onto the pedestal. The appliance may then be adjusted on the pedestal prior to tightening.

In an aspect, an expanding pedestal for an appliance may include a support frame for supporting the appliance including a plurality of pivotable supports moveable between a collapsed state and an expanded state; a worm gear connected to at least one of the pivotable supports to move the pivotable supports between the collapsed state and the expanded state; and magnetic panels configured to be attached to the pivotable supports when in the expanded state to obscure the support frame.

In an aspect, a device for aligning and securing an appliance with a pedestal, may include a flexible cover configured to be wrapped around a foot of the appliance, the cover including a magnetic material configured to cooperate with a magnetic plate positioned within the pedestal for securing the appliance with the pedestal.

In another aspect, the flexible cover further includes at least one pin extending therefrom and configured to mate with a pin locator of the pedestal.

In an aspect, a foot of an appliance, may include a base attached to a shaft, the base configured to be arranged on a pedestal and the shaft configured to attach to the appliance above the pedestal; and a cover having magnetic properties configured to surround at least a portion of the foot and be attached thereto and to magnetically mate with a magnetic portion of the pedestal to maintain the pedestal on the appliance.

In another aspect, the cover includes at least one pin extending therefrom and configured to mate with a pin locator defined by the pedestal to align the appliance and the pedestal during installation.

In an aspect, a foot of an appliance may include a resilient surface attached to a threaded shaft, the resilient surface configured to rest upon a pedestal and the shaft configured to attach to the appliance above the pedestal; a magnetic component associated with the resilient surface of the shaft to cooperate with a mating magnetic component to maintain positioning of the surface on the pedestal; and a pin extending from the resilient surface for cooperating with a mating hole in the pedestal.

In an aspect, an appliance pedestal may include a top surface; a magnetic plate located near a corner of the top surface for magnetically mating with a foot of an appliance; and a pivot pin extending from a support structure that is moveable between an open position and a locked position, wherein the locked position limits movement of the foot with respect to the pedestal.

In an aspect, a connector for an appliance pedestal may include a circular cover defining an opening in the center therefor and configured to receive a foot of an appliance; and a plurality of grippers extending radially inwardly from an outer perimeter of the cover and configured to expand upon rotation of the cover to engage and secure the foot.

In another aspect, the grippers are made of at least one of metal and silicon.

In yet another aspect the grippers are configured to retract radially inwardly towards an outer perimeter of the cover upon an opposite rotation of the cover to disengage the foot.

In an aspect, a system for connecting a pedestal to an appliance may include an appliance rail arranged on an underside of the appliance extending in a first direction, the appliance rail configured to mate with a corresponding pedestal rail arranged on the pedestal to prevent movement of the appliance in second direction; and at least one locking block attached to the either the appliance rail or the pedestal rail to prevent movement of the appliance in the first direction.

In another aspect, the appliance rail includes at least two parallel rails each configured to mate with a corresponding rail arranged on the pedestal.

In an aspect, a strap assembly for securing an appliance with a pedestal, may include a strap configured to form a continuous belt around each foot of the appliance; and a ratchet fixed to the strap and arranged at a front side of the appliance to tighten the strap and increase a pull force on the feet of the appliance in response to actuation of the ratchet in order to prevent movement of each foot of the appliance.

In another aspect, a plate may be arranged on a shaft associated with each foot of the appliance where the strap is configured to engage the shaft to move the plate down over one of the feet of the appliance.

In an aspect, a latch system for a pedestal may include a flexible strap attached to a top of the pedestal, the flexible strap defining a loop configured to receive a foot of an appliance arranged above the pedestal to fix the appliance to the pedestal; and a grommet configured to be received by an opening in a drip pan of the appliance to create a hermetical seal with the drip pan to prevent leaking.

In another aspect, a frame of the pedestal includes four sides forming four corners; and at least one draw latch disposed near at least one of the corners of the frame of the pedestal, the draw latch including a hook configured to engage and tighten around a foot of an appliance upon actuation of a lever to maintain the appliance on the pedestal.

In an aspect, a pedestal latch system for maintaining a foot on a pedestal may include an elastic latch disposed at a top of the pedestal and configured to extend across the foot of an appliance at both sides of a shaft of the foot; and an eyelet arranged on a side of the pedestal and configured to receive the latch to prevent movement of the foot with respect to the pedestal.

In an aspect, a connector for an appliance pedestal may include an attachment mechanism including a plurality of extendable supports projecting radially outwardly from a center of the pedestal; and a knob configured to attach to the attachment mechanism at the center of the pedestal and expand the supports radially outwardly until the supports abut feet of an appliance arranged on the pedestal.

In a further aspect, the plurality of extendable supports includes four supports forming an x-shape.

In a further aspect, a grip portion may be arranged at a distal end of each support and configured to abut the feet.

In a further aspect, a corner bracket may be arranged at each corner of the pedestal and configured to bias a force imposed on a respective foot.

In an aspect, a connector for an appliance pedestal may include an attachment mechanism including a plurality of supports extending radially outwardly from a center of the pedestal; and a knob configured to attach to the attachment mechanism at the center of the pedestal and expand the supports radially outwardly until the supports abut feet of an appliance arranged on the pedestal.

In an aspect, an attachment mechanism for securing an appliance to a pedestal may include a central body portion disposed below a center of an underside of the appliance; and a plurality of supports extending radially outwardly from the central body portion, each support extending to abut a foot of the appliance, wherein the central body portion is configured to attach to a pedestal attachment arranged at a center of the pedestal.

In a further aspect, each support is pivotable and extendable from the central body portion to adjust to a foot location.

In an aspect, an adjustable pedestal connector includes an attachment system for securing an appliance to a pedestal including an appliance connector disposed below a center area of an underside of the appliance and including a central body portion and a plurality of supports extending radially outwardly from the central body portion to abut a foot of the appliance; and a pedestal connector arranged centrally on the pedestal and configured to attach to the appliance connector.

In a further aspect, the pedestal connector defines a plurality of openings configured to secure and receive at least a portion of each of the supports of the appliance connector in an installed state.

In an aspect, a bracket assembly for aligning and securing an appliance with a pedestal includes a pair of appliance brackets arranged at opposites sides of the appliance and configured to extend from one edge of the appliance to another, the appliance bracket defining at least one opening configured to receive a shaft of the foot of the appliance, the appliance bracket including a lip extending downward and away from the appliance at the ends of the brackets to engage with a drip tray arranged on the pedestal.

In a further aspect, the lips define at least one aperture configured to align with an aperture of the drip tray to receive an attachment mechanism therethrough to secure the appliance bracket to the drip tray of the pedestal.

In a further aspect, a foot bracket is configured to receive the shaft of the foot and be arranged at the corners of the appliance contiguous to the appliance bracket such that the appliance bracket is arranged between the appliance and the foot bracket.

In a further aspect, the appliance brackets are arranged parallel to each other.

In a further aspect, a cross bracket is configured to be attached to the drip tray and to engage with the lip of the appliance bracket.

In an aspect, an adjustable pedestal connector includes at least one sliding bracket configured to be arranged within a drip plan on top of a pedestal and including two portions, one configured to nest and slide within the other to create a custom width to fit within the drip tray, wherein at least one of the two portions define a notch on a distal end thereof to abut a shaft of an appliance foot in an installed and expanded position.

In a further aspect, a bushing is configured to be installed on the shaft of the foot to receive a portion of the respective piece at the notch.

In a further aspect, one of the two portions is a top rail and the other of the two portions is a bottom rail, each engaged with a gear arranged therebetween, where the rotation of the gear either retracts or expands the rails to provide the custom width to fit within the drip tray.

In a further aspect, the bottom rail defines an opening at the distal end configured to receive the shaft of the foot of the appliance to fix the drip tray to the appliance.

In a further aspect, the at least one sliding bracket includes a pair of brackets spaced and parallel to one another within the drip tray.

In a further aspect, a pair of threaded rods are arranged perpendicular to the brackets and movable laterally there along.

In a further aspect, a plurality of lock nuts are arranged along each of the threaded rods and configured to secure the connector in place within the drip pan.

In an aspect, an appliance bracket includes four corner brackets each having a pair of legs forming a right angle at the corner thereof, each leg defining an opening configured to overlap with the opening of the adjacent bracket, wherein the openings are elongated allowing for varying overlap between the adjacent legs to allow for a custom length between the two corner brackets; an attachment mechanism configured to connect the two legs to fix the length of the bracket; and a pedestal bracket configured to be arranged on a pedestal beneath the appliance and attach to the appliance bracket to secure the pedestal to the appliance.

In a further aspect, the pedestal bracket includes four pedestal lips extending in a first direction, the pedestal lips being equidistantly spaced around the pedestal bracket.

In a further aspect, at least one of the corner brackets of the appliance bracket includes a corner lip extending in a second direction and configured to attach to at least one of the pedestal lips of the pedestal bracket.

In a further aspect, each of the pedestal lips correspond to one of the corner lips in an attached configuration.

In an aspect, an adjustable pedestal connector includes an appliance base configured to be arranged on an underside of an appliance, and includes a foot bracket arranged at each corner thereof, where each foot bracket includes a support configured to receive the foot and attached to the base via a pin allowing the foot bracket to be movable in each of a radial and lateral position to adjust the placement of the foot; and at least one projection arranged on an underside of the appliance base and configured to be received by at least one retention rod attached to a pedestal to secure the pedestal to the appliance.

In a further aspect, the rod further includes a biasing member arranged therein and configured to impart force on the projection to secure the pedestal in the locked position.

In a further aspect, the support defines an elongated slot configured to receive both a shaft of the foot and the pin.

In a further aspect, the retention rod defines at least one opening configured to receive the at least one projection of the appliance base.

Accordingly, various embodiments allowing for more universal and easier to install pedestal attachments are disclosed herein.

Although the foregoing content is directed to the embodiments of the present disclosure, other and additional embodiments of the present disclosure may be conceived without departing from the basic scope of the present disclosure, and the scope of the present disclosure is determined by the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An adjustable pedestal connector, comprising:

at least one sliding bracket configured to be arranged within a drip tray on top of a pedestal and including two portions, one configured to nest and slide within the other to create a custom width to fit within the drip tray, wherein at least one of the two portions define a notch on a distal end thereof to abut a shaft of an appliance foot in an installed and expanded position.

2. The connector of claim 1, further comprising a bushing configured to be installed on the shaft of the foot to receive a portion of the respective piece at the notch.

3. The connector of claim 1, wherein one of the two portions is a top rail and the other of the two portions is a bottom rail, each engaged with a gear arranged therebetween, where the rotation of the gear either retracts or expands the rails to provide the custom width to fit within the drip tray.

4. The connector of claim 3, wherein the bottom rail defines an opening at the distal end configured to receive the shaft of the appliance foot to fix the drip tray to the appliance.

5. The connector of claim 1, wherein the at least one sliding bracket includes a pair of brackets spaced and parallel to one another within the drip tray.

6. The connector of claim 5, further comprising a pair of threaded rods arranged perpendicular to the brackets and movable laterally there along.

7. The connector of claim 6, further comprising a plurality of lock nuts arranged along each of the threaded rods and configured to secure the connector in place within the drip tray.

* * * * *